US006396016B1

(12) United States Patent
Lin et al.

(10) Patent No.: US 6,396,016 B1
(45) Date of Patent: May 28, 2002

(54) ELECTRONIC COMPONENT INCORPORATING PUSH SWITCH AND ROTARY ENCODER

(75) Inventors: Chen-Yu Lin; Pin-Chien Liao, both of Taoyuan (TW)

(73) Assignee: Darfon Electronics Corp. (TW)

( * ) Notice: Subject to any disclaimer, the term of this patent is extended or adjusted under 35 U.S.C. 154(b) by 0 days.

(21) Appl. No.: 09/590,889

(22) Filed: Jun. 9, 2000

(30) Foreign Application Priority Data

May 27, 1999 (TW) ..... 88108710 A

(51) Int. Cl.[7] ..... H01H 19/14
(52) U.S. Cl. ..... 200/564; 200/18
(58) Field of Search ..... 200/18, 7, 564

(56) References Cited

U.S. PATENT DOCUMENTS 5,593,023 A * 1/1997 Kaizaki et al. ..... 200/570
5,613,600 A * 3/1997 Yokoji et al. ..... 200/564
5,956,821 A * 9/1999 Kurek, III et al. ..... 24/458

* cited by examiner

*Primary Examiner*—P. Austin Bradley
*Assistant Examiner*—Lisa Nhung Klaus
(74) *Attorney, Agent, or Firm*—Oppenheimer Wolff & Donnelly, LLP

(57) ABSTRACT

The objective of the invention is to provide a compact and complex electronic component incorporating a rotary encoder capable of exact adjustment and a push switch with a long life-cycle. In order to achieve the objective, the push switch is fixed on a rear wall or a lower surface of the electronic component such that an essential of the push switch, i.e., a dome-shaped member, can be made larger and has longer fatigue life. Moreover, the rotary encoder includes a rotatable member and a resilient member. The rotatable member has a gear-shaped flange and is rotatable circumferentially relative to a central shaft of the rotary encoder. When the rotary encoder rotates, the resilient member, relative to the central shaft, is stationary. The resilient member has a V-shaped portion retained by a surface of the gear-shaped flange of the rotatable member such that the rotary encoder can be exact adjusted.

8 Claims, 20 Drawing Sheets

ELECTRONIC COMPONENT INCORPORATING PUSH SWITCH AND ROTARY ENCODER

FIELD OF THE INVENTION

The invention relates to a compact and complex electronic component incorporating a rotary encoder and a push switch or two push switches, and more in particular, to an electronic component incorporating a rotary encoder capable of precise adjustments and a push switch (or two push switches) with a long life-cycle.

BACKGROUND OF THE INVENTION

A compact and complex electronic component incorporating a rotary encoder and a push switch is widely employed in audio or video apparatuses. In the complex electronic component, the rotary encoder is useful for adjusting volume, frequency, time, etc., and the push switch is useful for switching to another option.

Hereinafter, a compact and complex electronic component developed by the Tsuyama Matsushita Electric Co. Ltd., which incorporates a rotary encoder and a push switch, will be described with reference to FIG. 1.

As shown in an outside perspective view in FIG. 1A, the complex electronic component 10 includes mainly a base plate 11, a rotary encoder 12, a push switch 13 and a mechanism 14 for selectively switching on the push switch 13. The push switch 13 is fixed on an upper surface of the base plate 11. The rotary encoder 12 is attached movably and rotatably on the base plate 11 and spaced a predetermined distance apart from the push switch 13. Moreover, the rotary encoder 12 is capable of moving toward the push switch 13. When the movement of the rotary encoder 12 toward the push switch 13 takes place, the mechanism 14 is actuated to switch on the push switch 13. The base plate 11 need not be made of a metal, but may be molded of a resin.

The arrangement and cooperation between the members consisting of the electronic component 10 can be understood by FIG. 1B and 1C. FIG. 1B is an exploded perspective view of the electronic component 10. FIG. 1C is a sectional view of the electronic component 10 along A—A line in FIG. 1A.

The rotary encoder 12 and the push switch 13 will be described in detail, respectively. The rotary encoder 12 is composed of an operational member 121, a lid plate 122, a rotatable member 123, a contact plate 124, resilient contact legs (1251*a*, 125*b* and 125*c*), connecting terminals 133, and a bottom plate 126. The bottom plate 126 has a central shaft 1261 extending through the center of the rotary encoder 12, which rotates around the central shaft 1261. The operational member 121 is operated by one finger to rotate relative to the central shaft 1261 or to move toward the push switch 13. The lid plate 122 has a V-shaped portion projecting downward. The rotatable member 123 has teeth arranged around the circumference of its upper surface. The contact plate 124 is disposed on the lower surface of the rotatable member 123. There are openings through the contact plate 124 and disposed along the circumference of the contact plate 124. The rotatable member 123 is molded of a resin and formed together with the contact plate 124 such that the resin is filled within the openings of the contact plate 124.

The resilient contact legs (1251*a*, 1251*b* and 1251*c*) extend upwards from a thin metal sheet inserted-molded within the base plate 11. The connecting terminals 133 extend upwards from a side end of the thin metal sheet to provide connection of the rotary encoder 12 with an external circuit (not shown). The bottom plate 126 also has a support shaft 1262 for providing support to the rotary encoder 12 to rotate within a narrow range of angle when the rotary encoder 12 moves toward the push switch 13. Moreover, the base plate 11 has an elliptical hole 111 and a circular hole 112 for receiving the central shaft 1261 and the support shaft 1262, respectively. In general, the bottom plate 126 is made of a metal. When the operational member 121 rotates, the rotatable member 123 and the contact plate 124 rotates along with the operational member 121.

In contrast, the lid plate 122 is engaged with the central shaft 1261 to be stationary relative to the central shaft 1261. In particular, the V-shaped portion of the lid plate 122 is retained by a surface of the teeth of the rotatable member 123 such that the lid plate 122 can provide resistance as the rotary encoder 12 rotates.

The contact legs (1251*a*, 1251*b* and 1251*c*) are disposed on a lower surface of the contact plate 124. When the operational member 121 rotates, the resilient contact legs 1251 slide on the contact plate 124 to generate switching signals. The contact leg 1251*c* is always in touch with the contact plate 124. The contact leg 1251*a* and the contact leg 125*b* are in touch with the contact plate 124 alternately. According to the contact sequence of the contact legs (1251*a* and 1251*b*) with the contact plate 124, the external circuit will receive the switching signals to adjust the volume of the corresponding option.

Also shown in FIG. 1B, the push switch includes a conductive dome-shaped member 131, a conductive patterned member 132 mounted on the base plate 11, and connecting terminals 133. The connecting terminals 133 extend from the conductive patterned member 132 to provide connection of the push switch 13 with the external circuit. The dome-shaped member 131 has a circumference which contacts the patterned member 132. Moreover, the dome-shaped member 131 has a dome end. When the dome end of the dome-shaped member 131 is pressed to contact the patterned member 132, the push switch 13 is switched on. In general, the dome-shaped member 131 is best made of metal, which will make the assembly of the push switch 13 more convenient.

The mechanism 14 is pivotally connected to the base plate 11 such that the mechanism 14 is allowed to rotate within a predetermined range. The mechanism 14 has an end 141 adjacent to the dome end of the dome-shaped member 131 and a side 142 adjacent to an actuator 1263 attaching to the bottom plate 126. The actuator 1263 of the bottom plate 126 extends through a rectangular hole 113. When the rotary encoder 12 moves toward the push switch 13, the actuator 1263 is actuated to push the side 142 of the mechanism 14, and then the end 141 of the mechanism 14 presses the dome end of the dome-shaped member 131 down to switch on the push switch 13. By FIG. 1C, the arrangement and cooperation between the members consisting of the electronic component 10 can be understood well. FIG. 1C is a sectional view of the electronic component 10 along A—A line in FIG. 1A.

The disadvantage of the complex electronic component 10 of the Matsushita Co. is summarized as follows. First, based on the precondition that the compact size of the complex electronic component 10 can not be sacrificed, the diameter of the dome-shaped member is limited to be about 3 mm and the thickness of that the dome-shaped member 131 is about 0.1 mm. Due to small size of the dome-shaped member 131, in the complex electronic component 10, it is difficult for the dome-shaped member 131 to be fabricated and assembled with other members into the push switch 13. Also due to small size of the dome-shaped member 131, the fracture mode of the dome-shaped member 131 is low-cycle fatigue typically, i.e., the fatigue life of the dome-shaped member 131, formed of a iron material, is less than $10^6$ cycles. In practical application, the life cycle of the electronic component 10 mainly depends on the fatigue life of the push switch 13. When the dome-shaped member 131 is fractured, the electronic component 10 must be replaced.

Second, in the complex electronic component 10, when the rotary encoder 12 rotates, the lid plate 122 can not provide enough resistance so that the rotary encoder 12 is hard to precisely adjust.

Accordingly, to solve the aforesaid problems, this present invention provides a compact and complex electronic component incorporating a long life-cycle push switch and a specifically adjusted rotary encoder. In order to achieve the objective, the push switch is fixed on a rear wall or a lower surface of the electronic component such that the push switch can occupy a larger space without the need to sacrifice the compact size of the complex electronic component. Moreover, the rotary encoder includes a rotatable member which has a gear-shaped flange and is rotatable circumferentially and a resilient member which has a V-shaped portion retained by a surface of the gear-shaped flange of the rotatable member. When the rotary encoder rotates, the design can provide enough resistance so that the rotary encoder can be precisely adjusted.

An objective of the invention is to provide a compact and complex electronic component incorporating a rotary encoder and a push switch, or two push switches. In particular, in accordance with the invention, the push switch has a long life-cycle and the rotary encoder can be precisely adjusted.

SUMMARY OF THE INVENTION

An objective of the invention is to provide a compact and complex electronic component incorporating a rotary encoder and a push switch, or two push switches. In particular, in accordance with the invention, the push switch has a long life-cycle and the rotary encoder can be exact adjusted.

According to the invention, the rotary encoder is capable of moving toward the push switch. One corresponding mechanism selectively switches on the push switch in response to the movement of the rotary encoder toward the push switch.

According to the invention, the push switch is fixed on a rear wall or a lower surface of the electronic component such that an essential of the push switch, i.e., a dome-shaped member, has a larger size and high fatigue life.

According to the invention, the rotary encoder includes a rotatable member which has a gear-shaped flange and is rotatable circumferentially and a resilient member which has a V-shaped portion retained by a surface of the gear-shaped flange of the rotatable member such that the rotary encoder can be precisely adjusted.

The advantages and spirit of the invention may be understood by the following recitations together with the appended drawings.

BRIEF DESCRIPTION OF THE APPENDED DRAWINGS

FIG. 1A is an outside perspective view of a complex electronic component 10 that is developed by the Matsushita Co. and incorporates a push switch 13 and a rotary encoder 12.

Figure 2A:
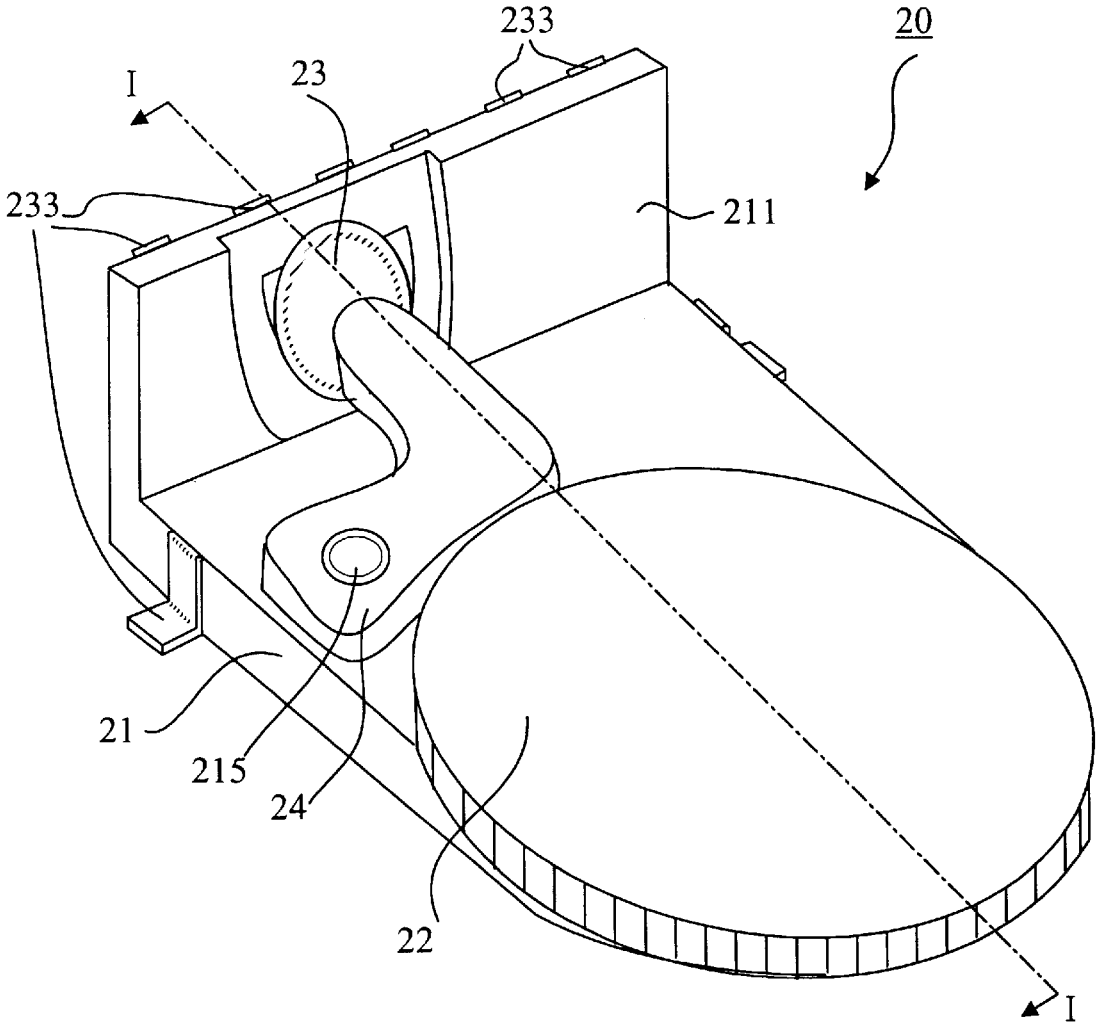
FIG. 2A is an outside view of an electronic component 20 in accordance with a first embodiment of the invention.
Figure 2B:
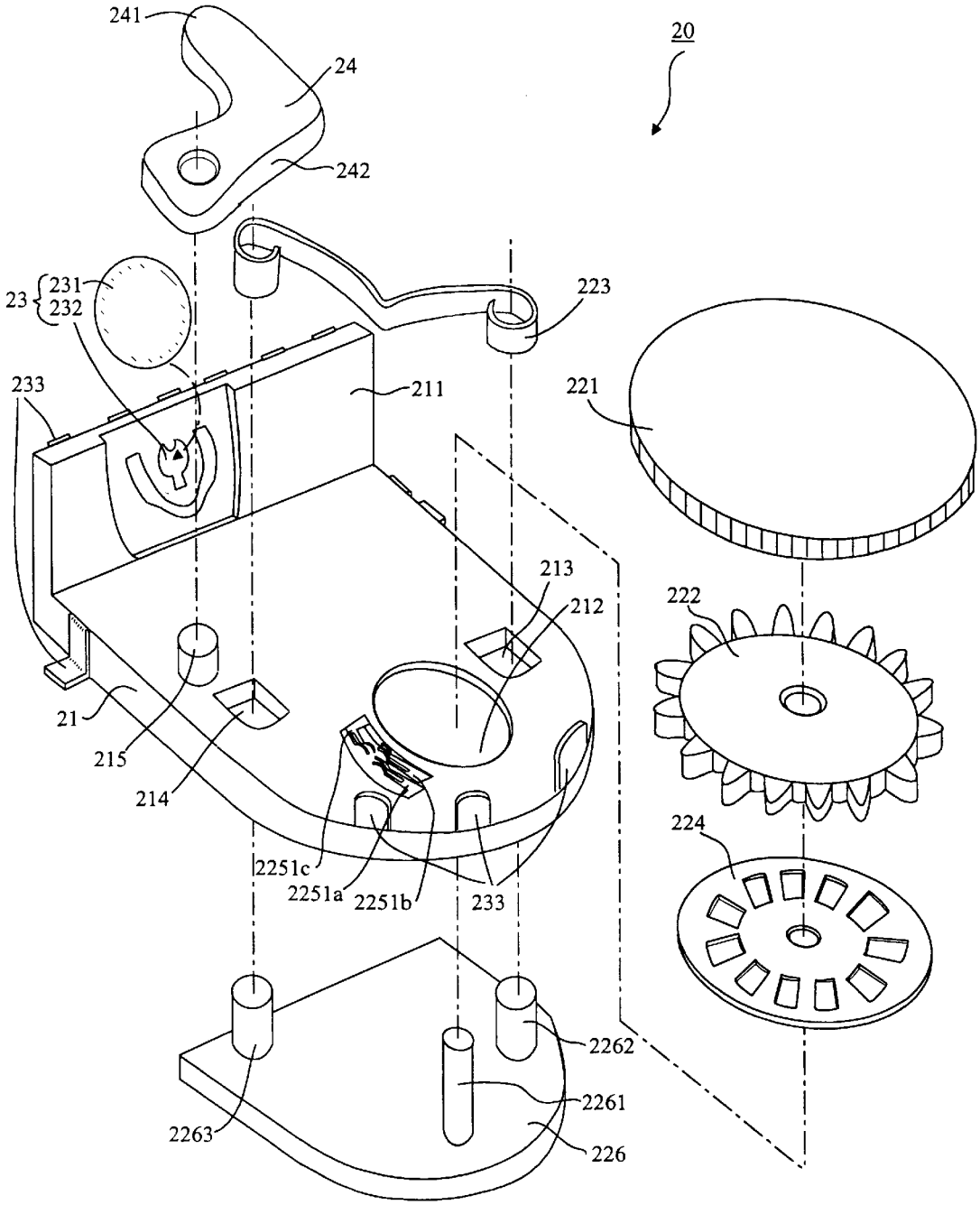
FIG. 2B is an exploded perspective view of the electronic component 20 of FIG. 2A.
Figure 2C:
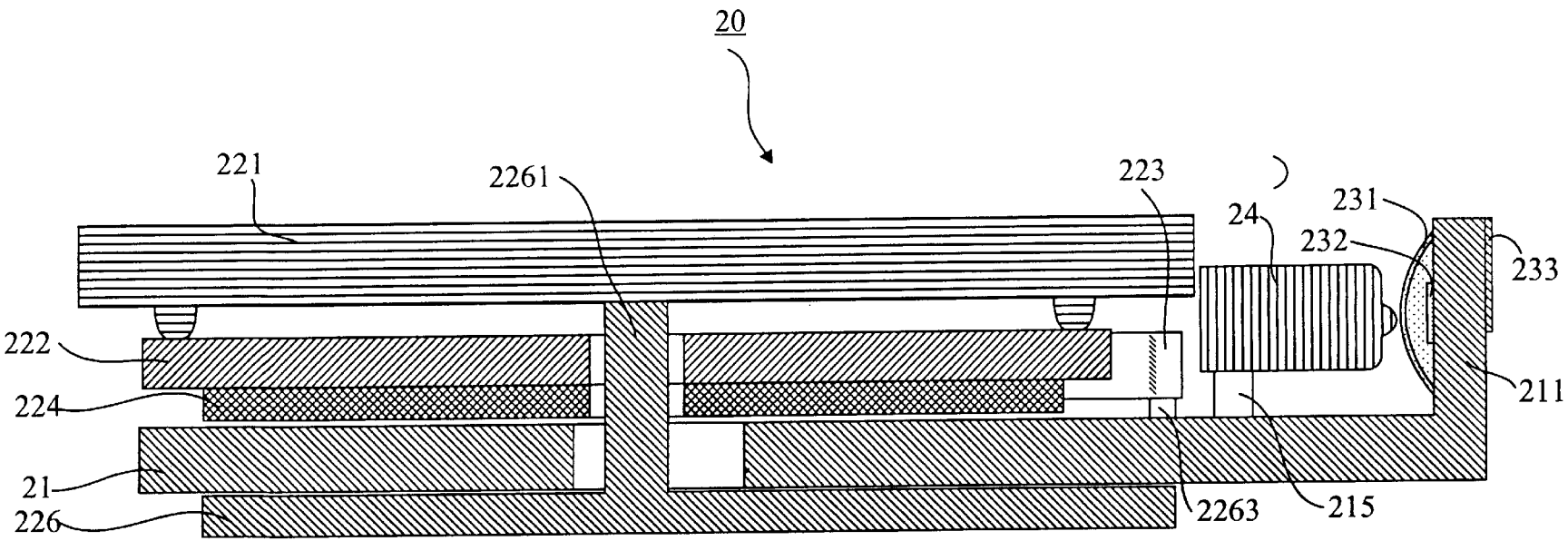
FIG. 2C is a cross section view of the electronic component 20 of FIG. 2A along A—A line.
Figure 2D:
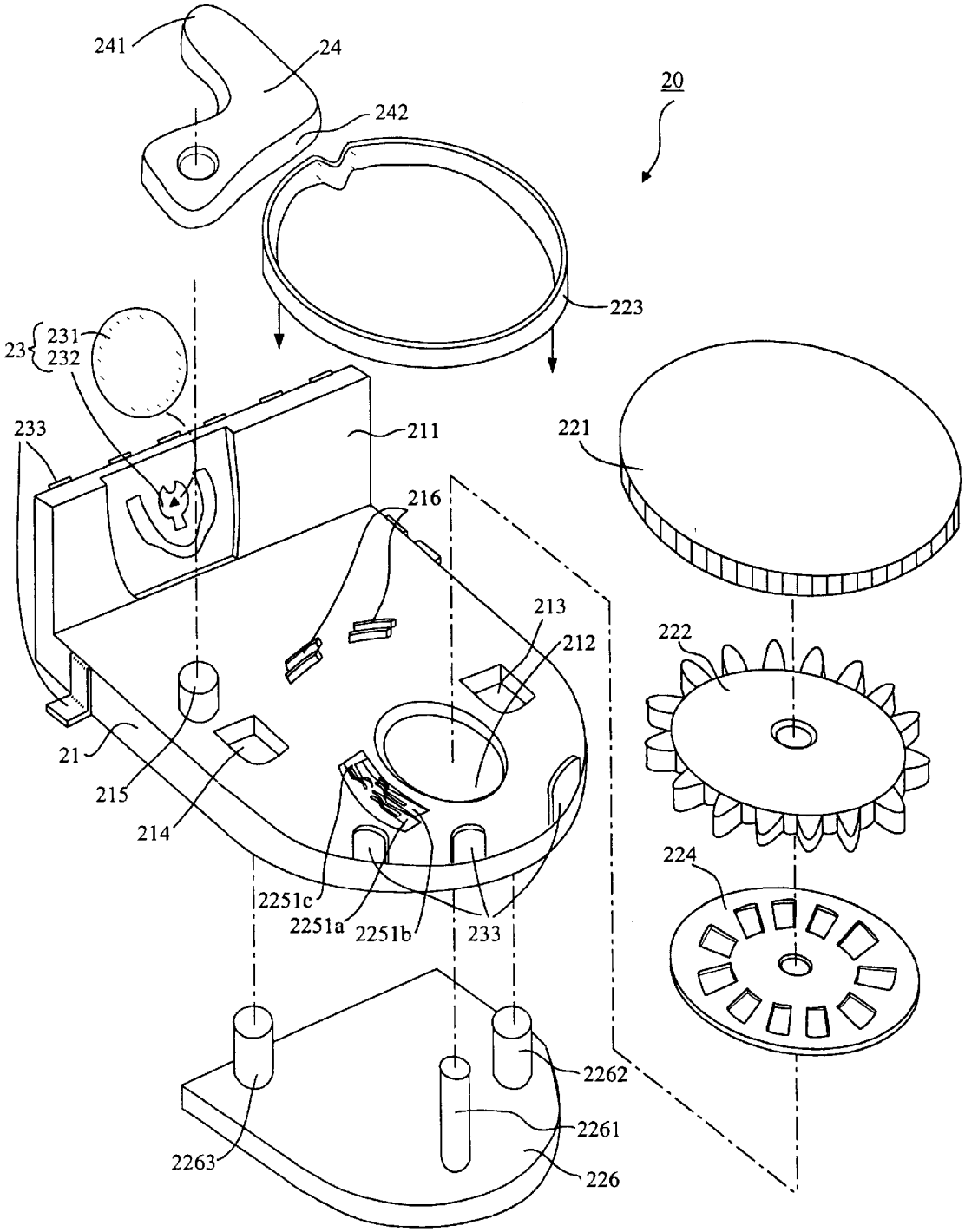
FIG. 2D is an exploded perspective view showing the electronic component 20 with an alternative resilient member capable of resisting the rotary operation of the rotary encoder 22.
Figure 2E:
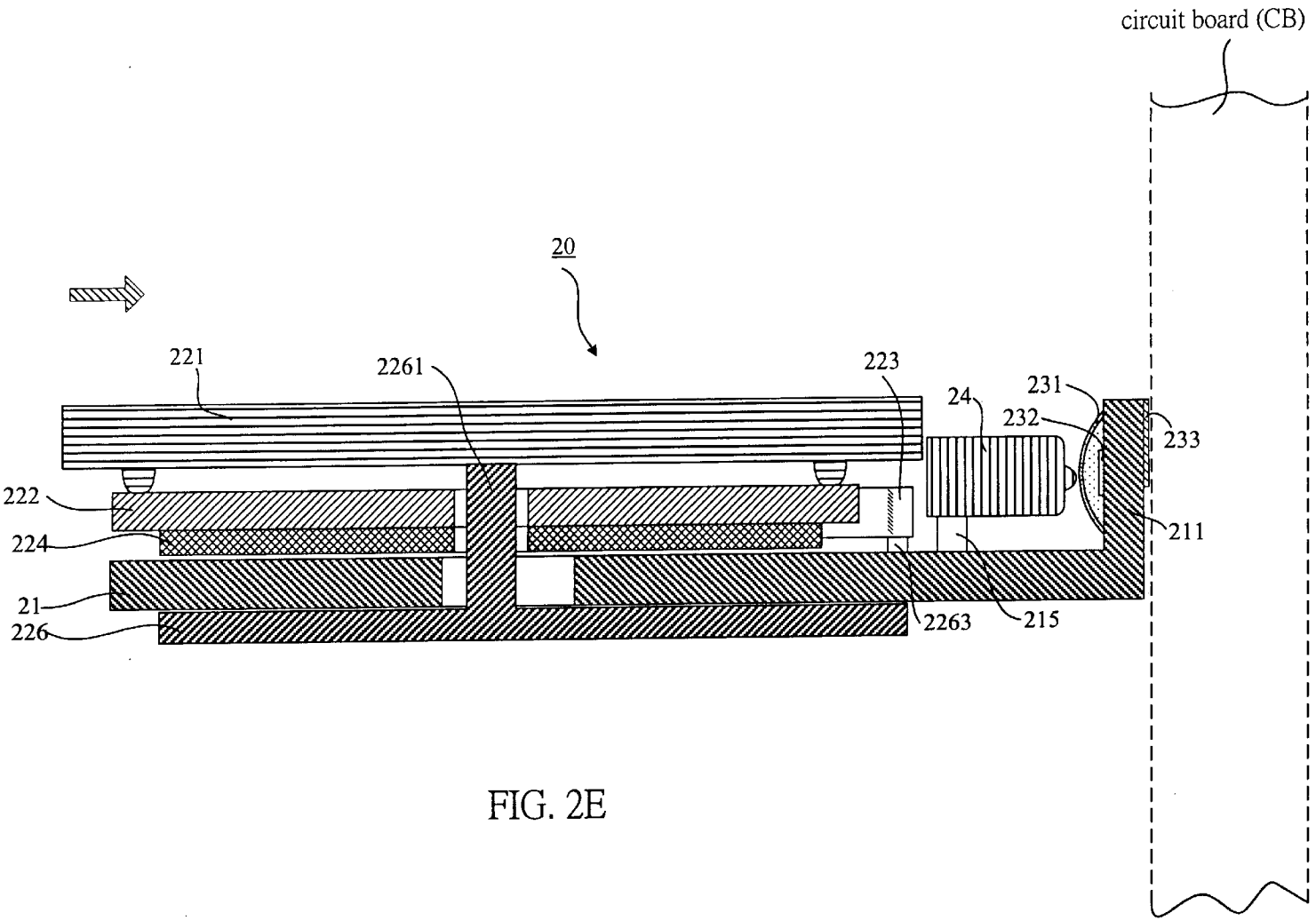

FIG. 2E is a cross section view of the electronic component 20 of FIG. 2A along the A—A line. To the right of the electronic component 20, a circuit board is illustrated. The electronic component 20 is connected to the circuit board (CB) by the weld 233. When a user presses the operational member 221 in the direction illustrated by the arrow sign in FIG. 2E, the circuit board (CB) can provide sufficient support and therefore strengthen the electronic component 20.

Figure 3A:
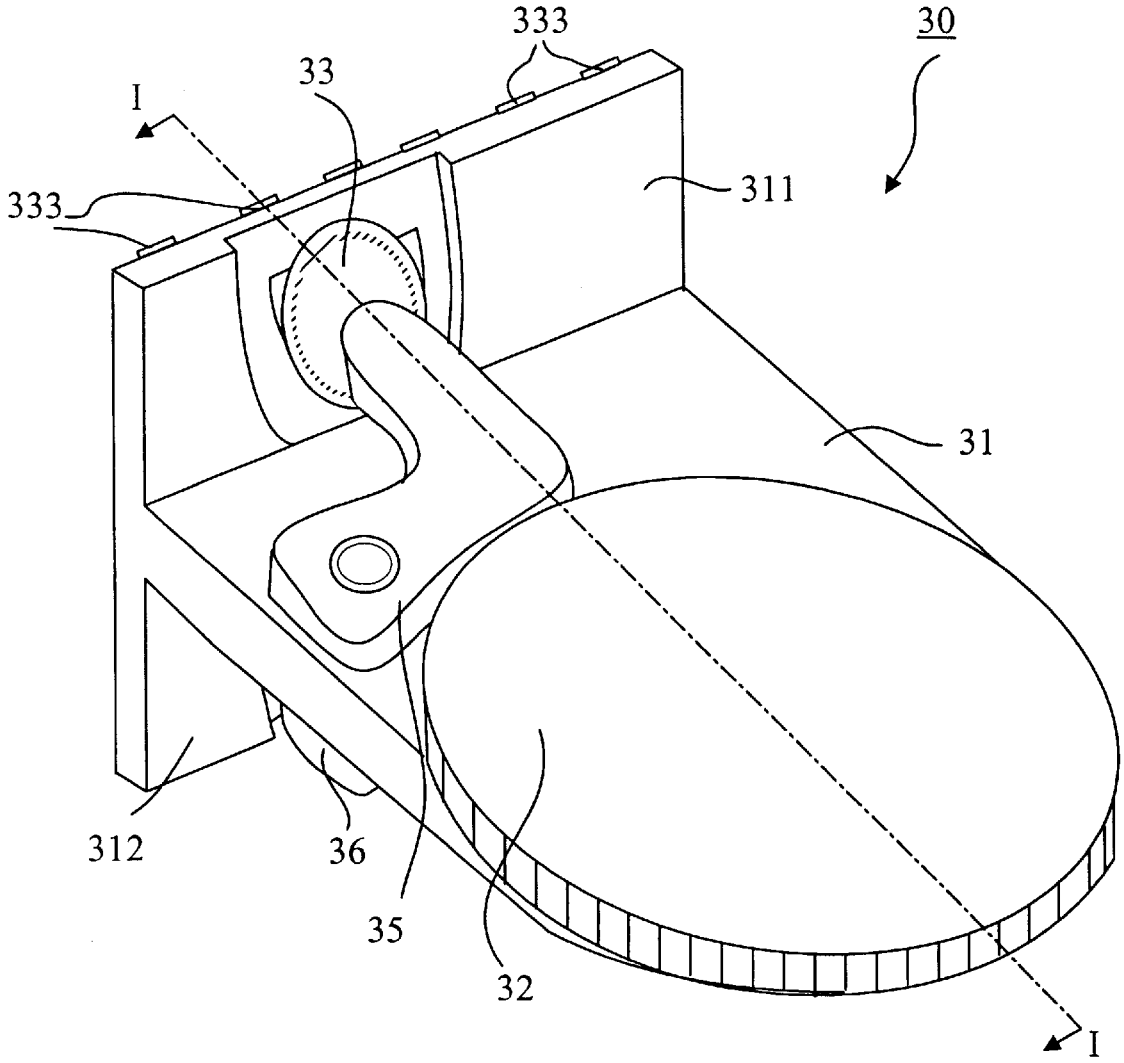

FIG. 3A is an outside view of an electronic component 30 in accordance with a second embodiment of the invention.

Figure 3B:
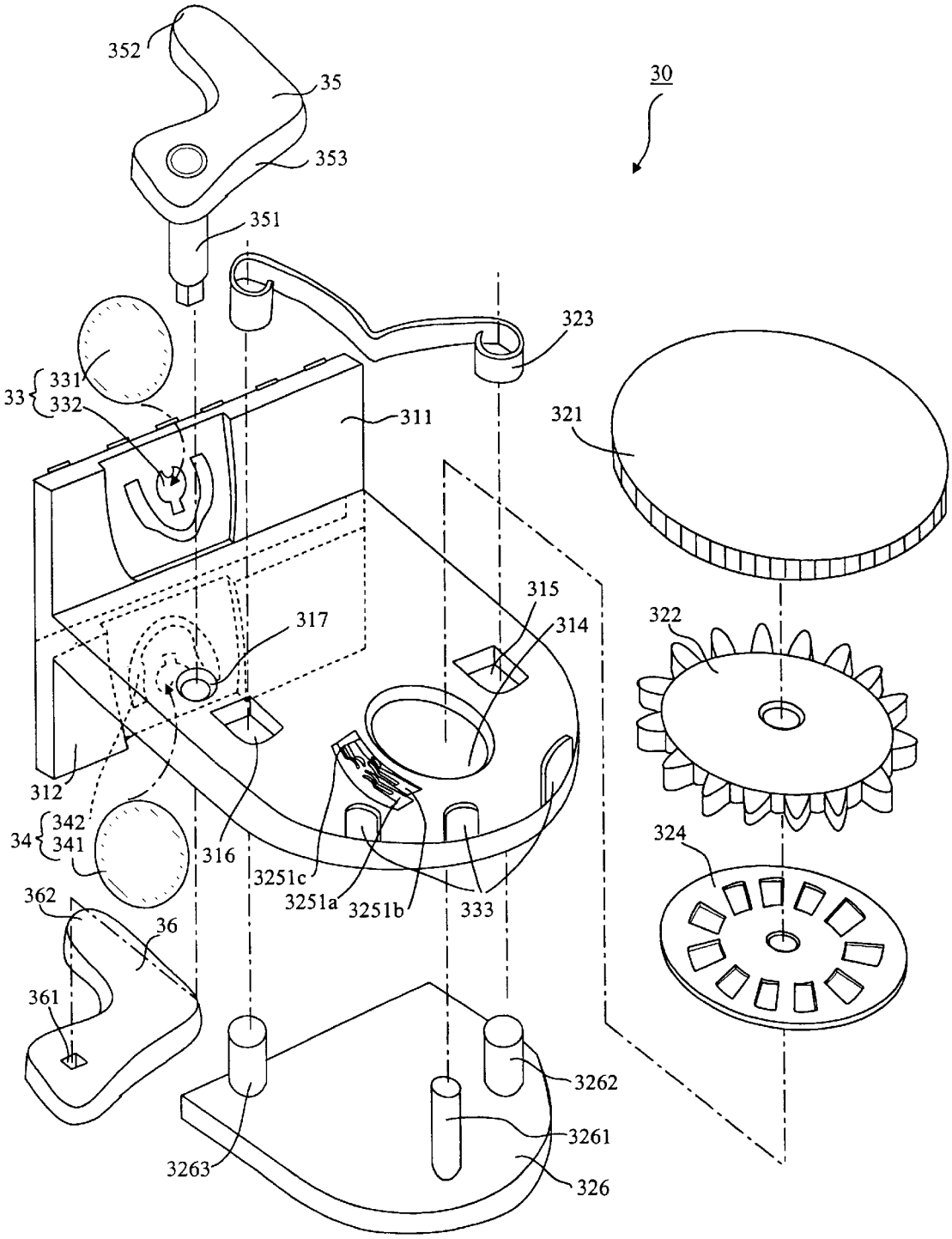

FIG. 3B is an exploded perspective view of the electronic component 30 of FIG. 3A.

Figure 3C:
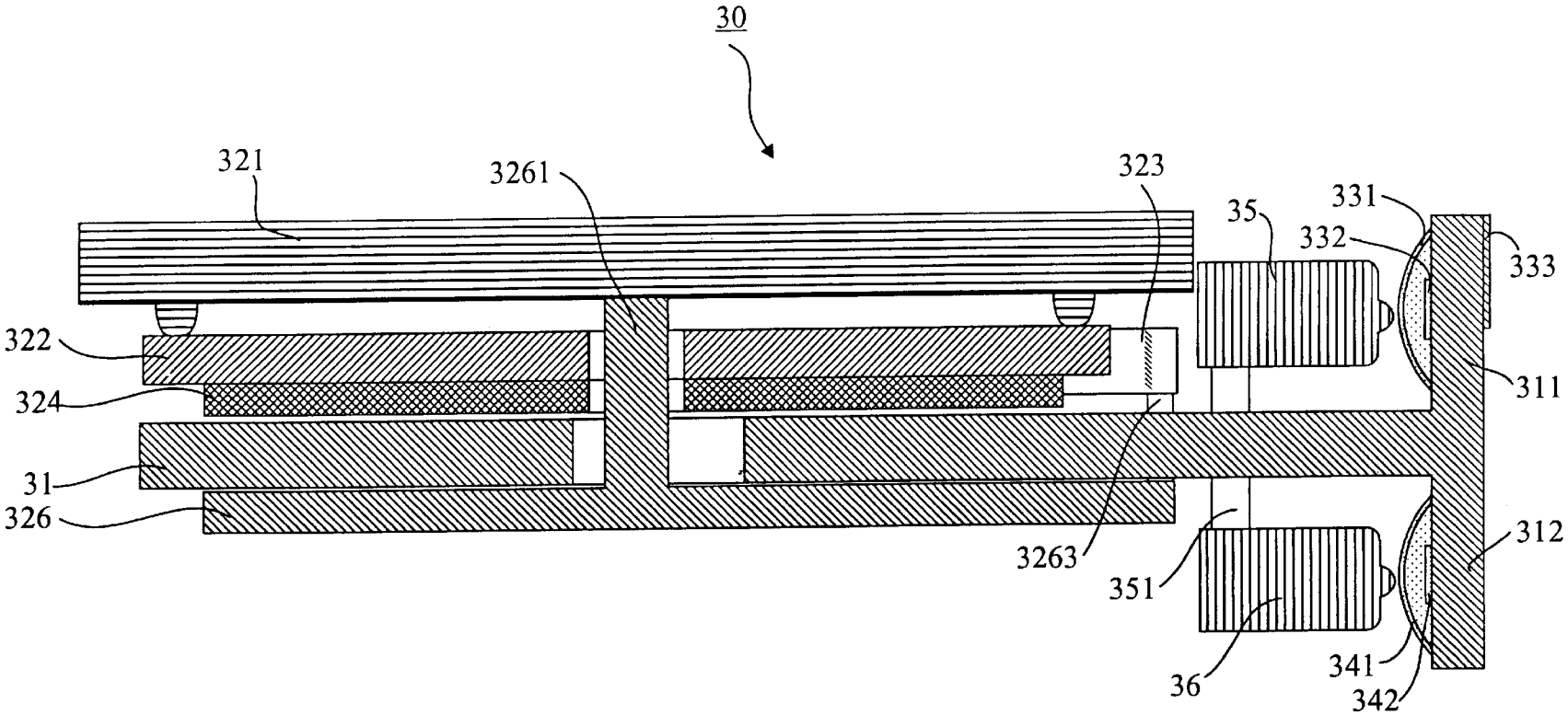

FIG. 3C is a cross section view of the electronic component 30 of FIG. 3A along A—A line.

Figure 4A:
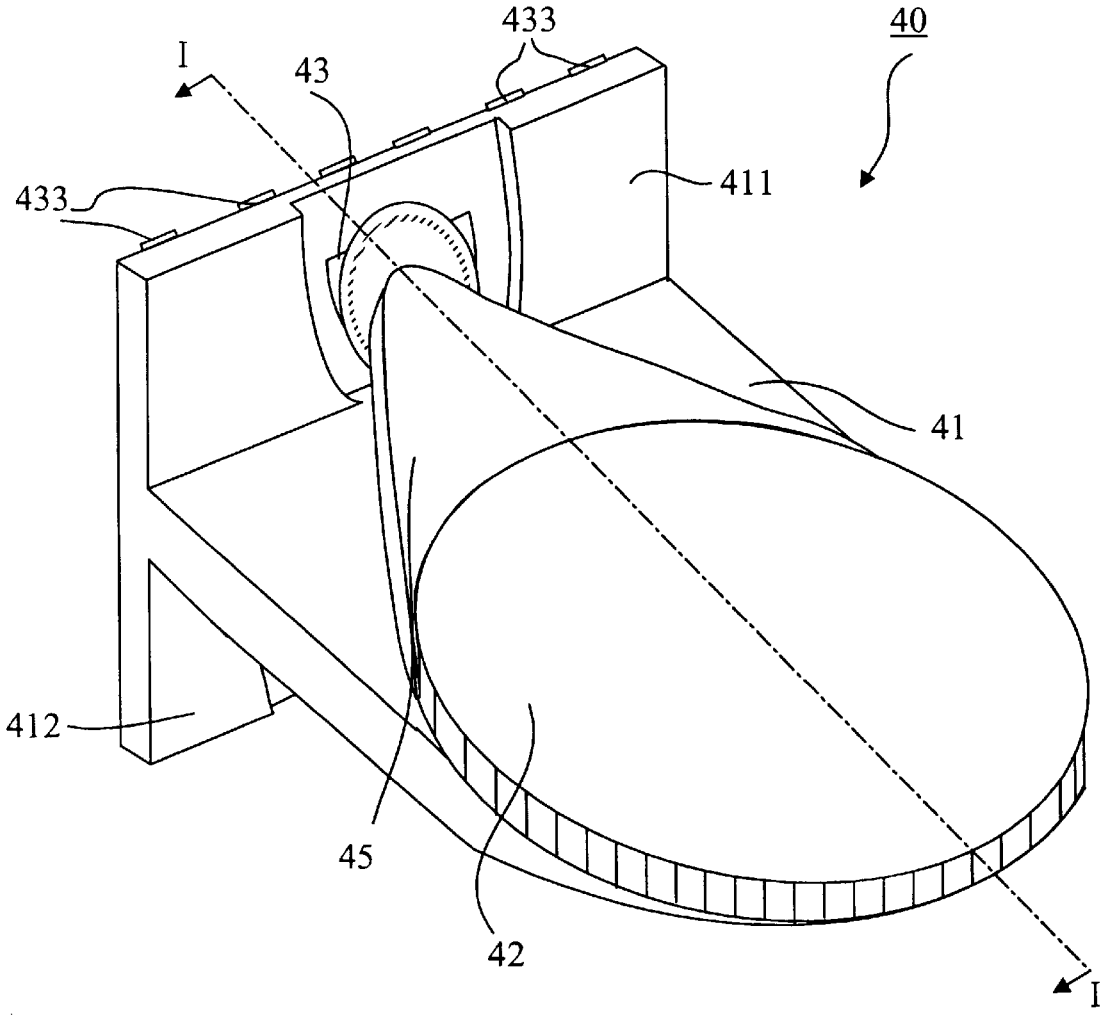

FIG. 4A is an outside view of an electronic component 40 in accordance with a third embodiment of the invention.

Figure 4B:
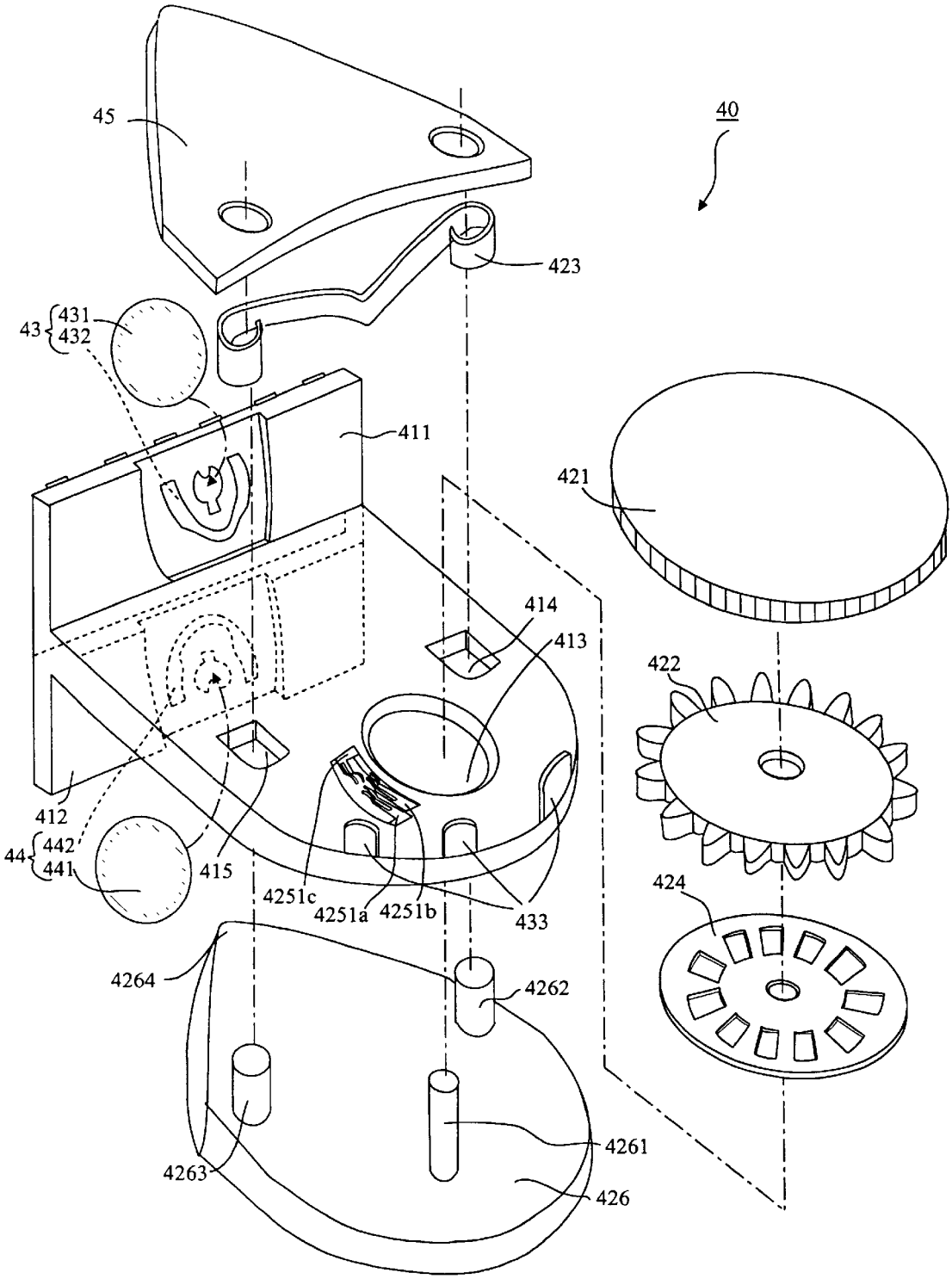

FIG. 4B is an exploded perspective view of the electronic component 40 of FIG. 4A.

Figure 4C:
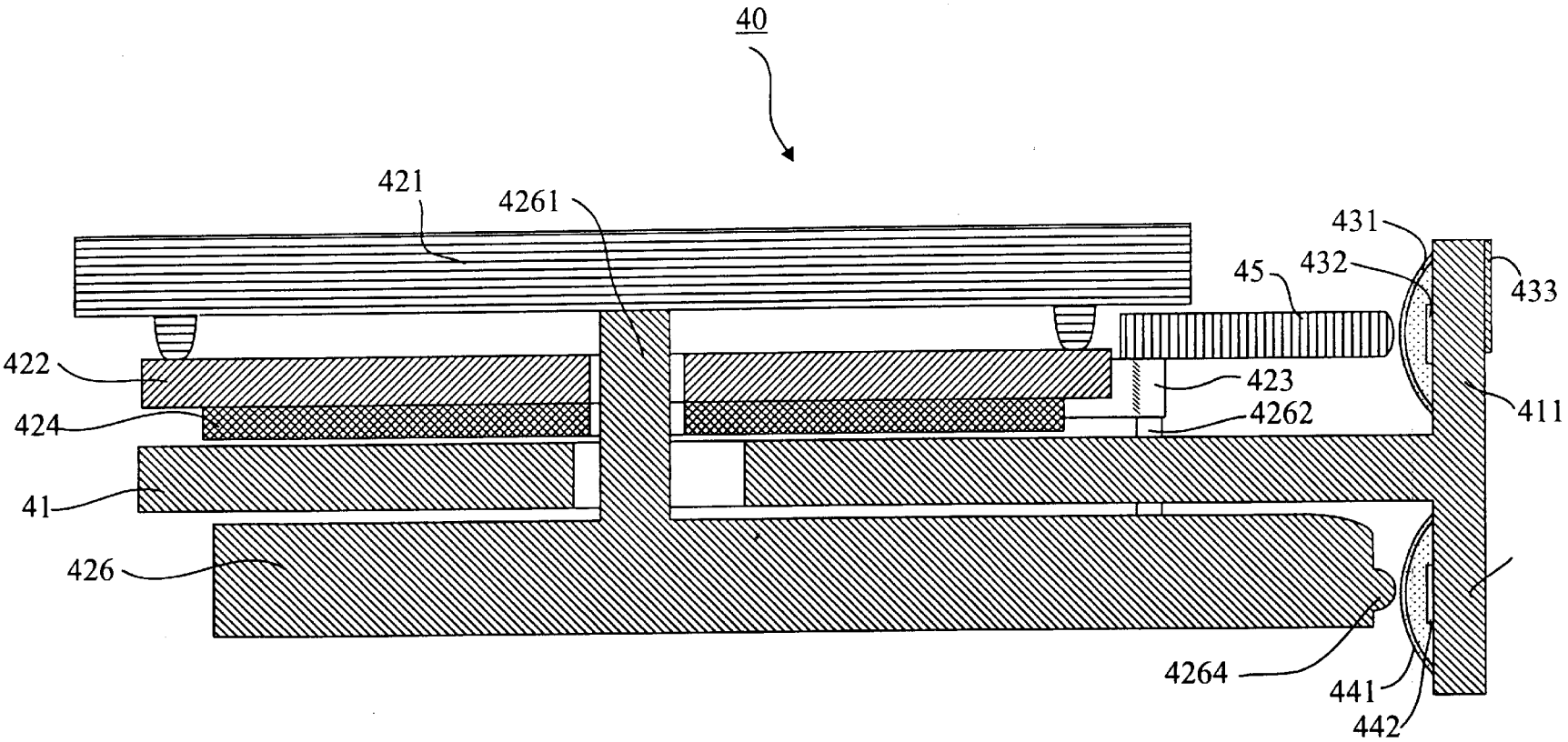

FIG. 4C is a cross section view of the electronic component 40 of FIG. 4A along A—A line.

Figure 5A:
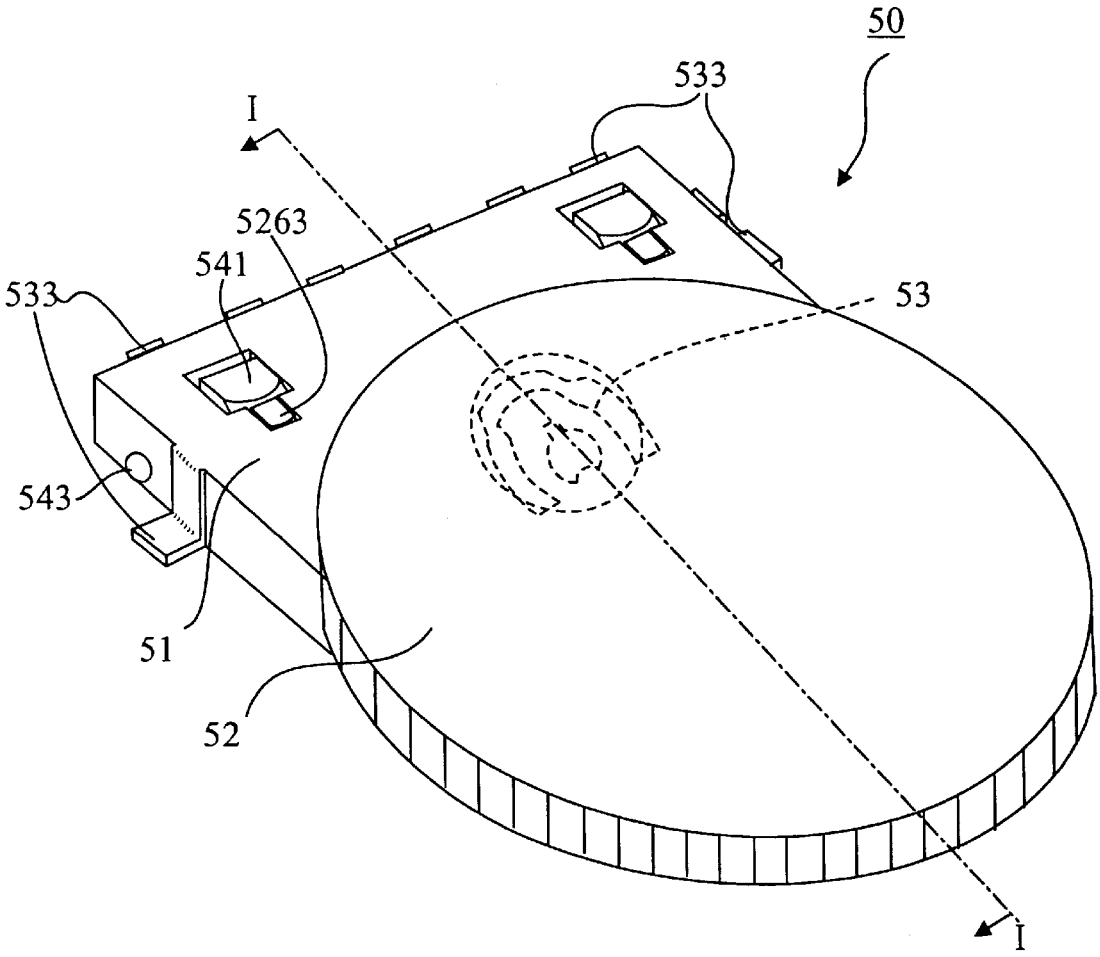

FIG. 5A is an outside view of an electronic component 50 in accordance with a fourth embodiment of the invention.

Figure 5B:
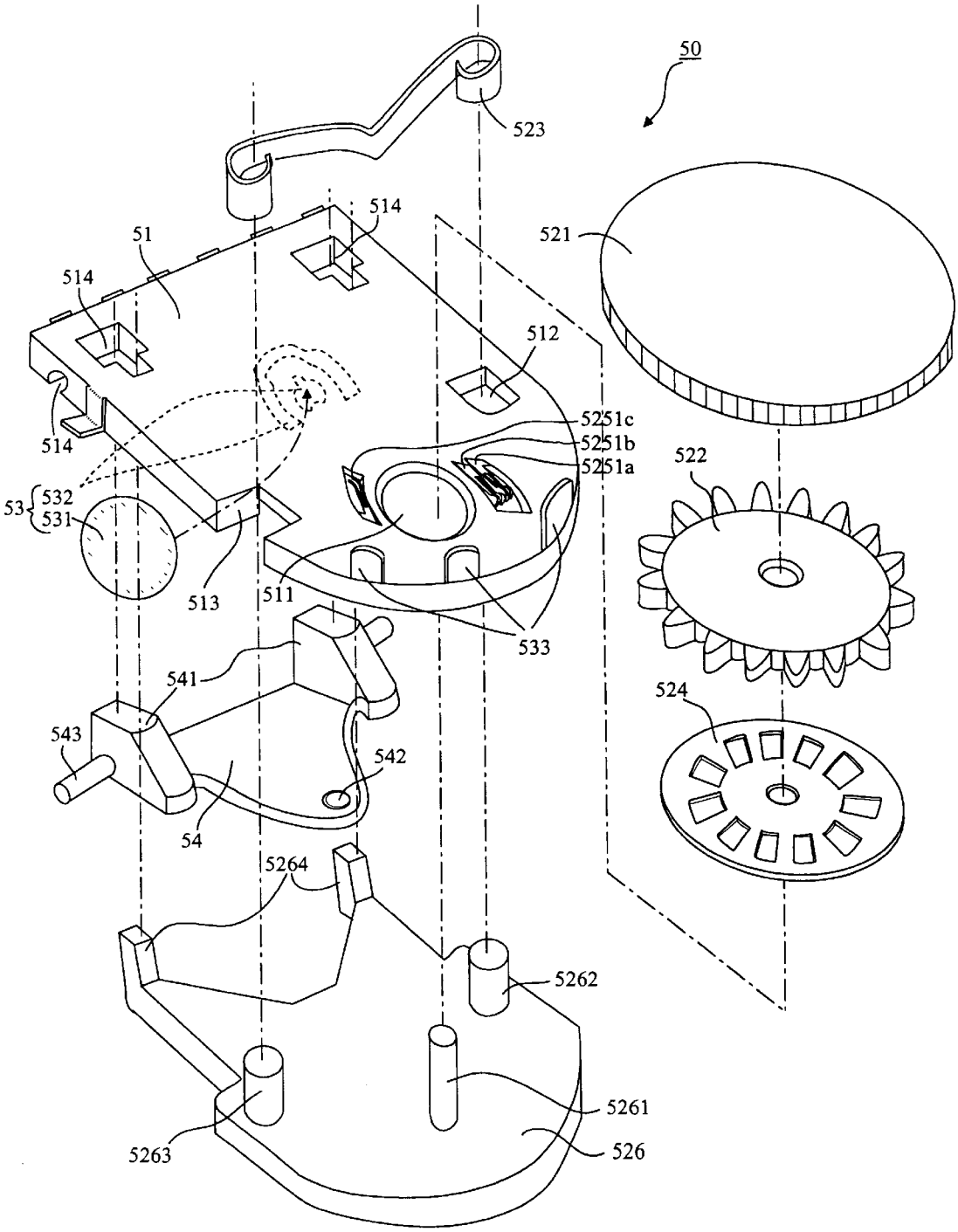

FIG. 5B is an exploded perspective view of the electronic component 50 of FIG. 5A.

Figure 5C:
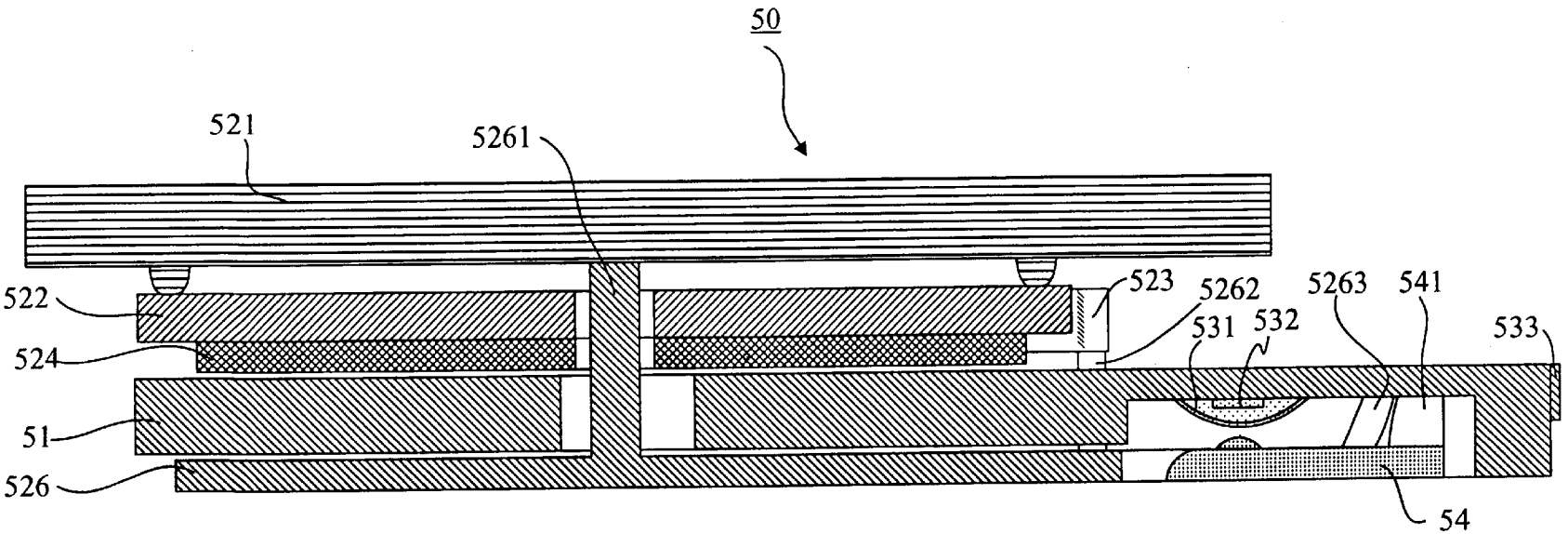

FIG. 5C is a cross section view of the electronic component 50 of FIG. 5A along A—A line.

Figure 6A:
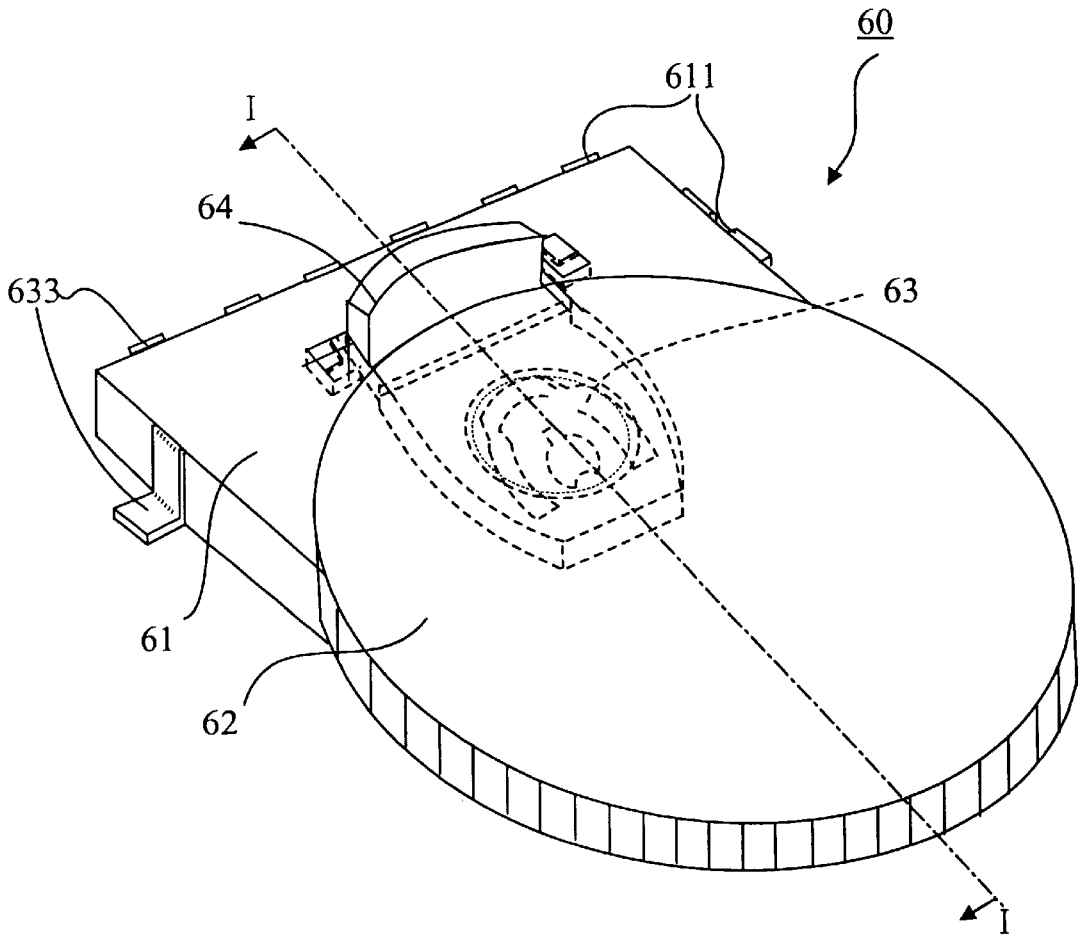

FIG. 6A is an outside view of an electronic component 60 in accordance with a fifth embodiment of the invention.

Figure 6B:
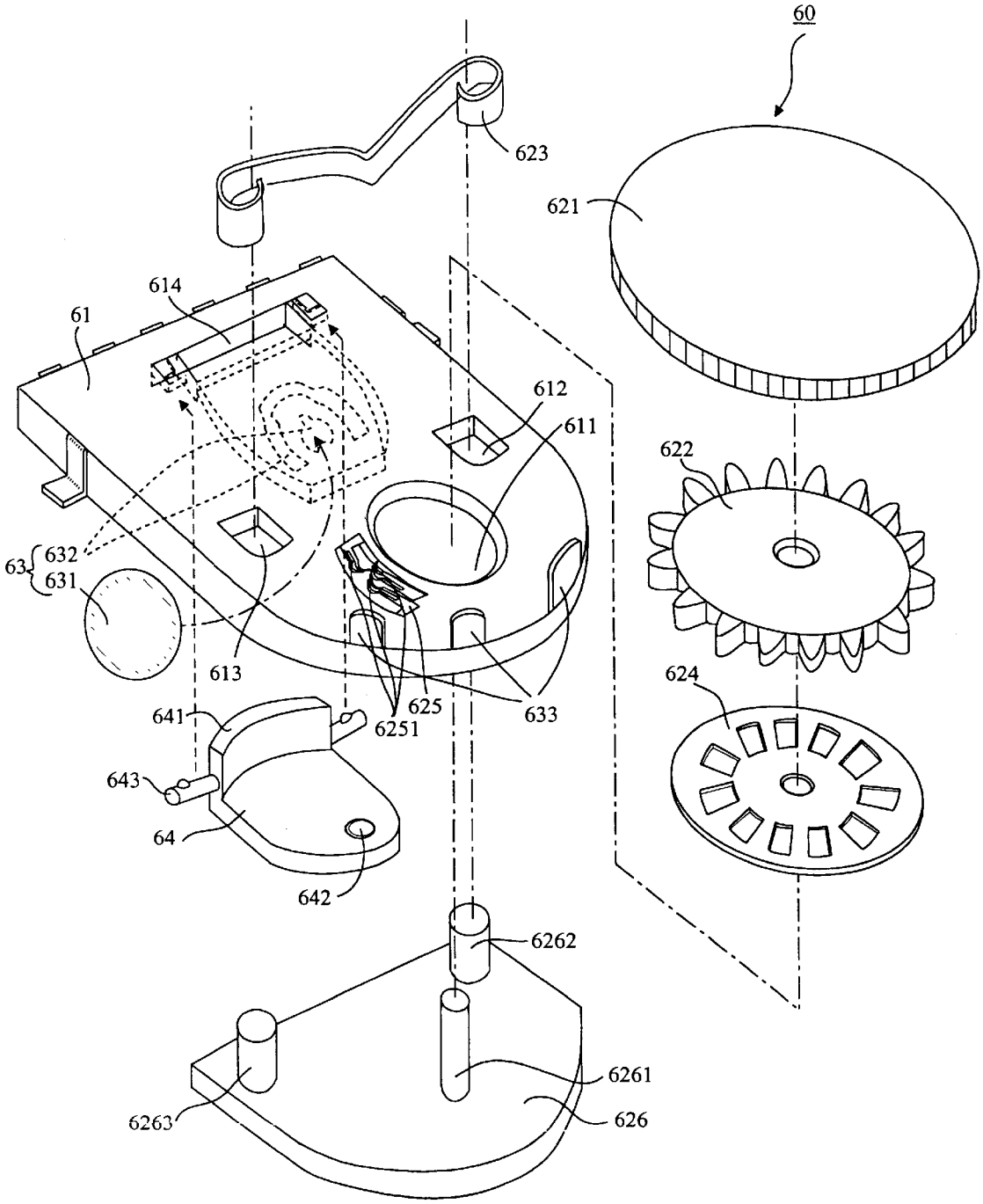

FIG. 6B is an exploded perspective view of the electronic component 60 of FIG. 6A.

Figure 6C:
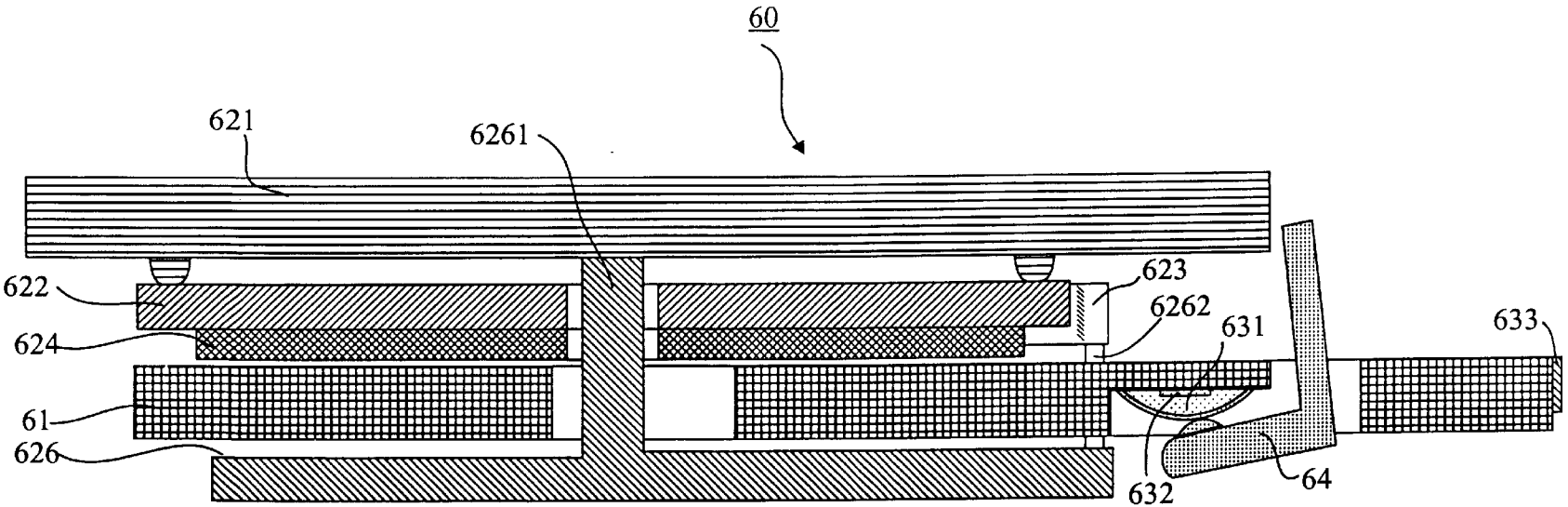

FIG. 6C is a cross section view of the electronic component 60 of FIG. 6A along A—A line.

DETAILED DESCRIPTION OF THE INVENTION

The invention provides a compact and complex electronic component incorporating a rotary encoder and a push switch, or two push switches. In the complex electronic component, the rotary encoder is useful for adjusting volume, frequency, time, etc., and the push switch is useful for switching another option. The rotary encoder is capable of moving toward the push switch (push switches). One corresponding mechanism selectively switches on the push switch in response to the movement of the rotary encoder toward the push switch. In particular, the push switch has a long life-cycle and the rotary encoder can be precisely adjusted. Several preferred embodiments of the invention are disclosed as follows.

Referring to FIG. 2, a first embodiment of the invention is described in detail. As shown in an outside perspective view in FIG. 2A, the complex electronic component 20, according to the first embodiment of the invention, mainly includes a base plate 21 having a rear wall 211, a rotary encoder 22, a push switch 23, and a mechanism 24 for selectively switching on the push switch 23. The push switch 23 is fixed on the rear wall 211. The rotary encoder 22 is attached movably and rotatably on the base plate 21 and spaced a predetermined distance apart from the push switch 23. In particular, the rotary encoder 22 is capable of moving toward the push switch 23. Moreover, when the movement of the rotary encoder 22 toward the push switch 23 takes place, the mechanism 24 is actuated to switch on the push switch 23.

The arrangement and cooperation between the members consisting of the electronic component 20 can be understood by FIG. 2B and 2C. FIG. 2B is an exploded perspective view of the electronic component 20. FIG. 2C is a sectional view of the electronic component 20 along A—A line in FIG. 2A.

FIG. 2E is a cross section view of the electronic component 20 of FIG. 2A along the A—A line. To the right of the electronic component 20, a circuit board is illustrated. The electronic component 20 is connected to the circuit board (CB) by the weld 233. When a user presses the operational member 221 in the direction illustrated by the arrow sign in FIG. 2E, the circuit board (CB) can provide sufficient support and therefore strengthen the electronic component 20.

Hereafter, the rotary encoder 22 and the push switch 23 will be described in detail, respectively. The rotary encoder 22 includes an operational member 221, a rotatable member 222, a resilient member 223, a contact plate 224, resilient contact legs (2251*a*, 2251*b* and 2251*c*), connecting terminals 233, and a bottom plate 226. The bottom plate 226 has a central shaft 2261 extending through the center of the rotary encoder 22, which rotates around the central shaft 2261. The central shaft 2261 also extends through an elliptical hole 212. Except for the bottom plate 226, all member of the rotary encoder 22 are attached movably above the base plate 21. The operational member 221 is operated by one operator's finger to rotate relative to the central shaft 2261 or to move toward the push switch 23. When the operational member 221 rotates, the rotatable member 222 and the contact plate 224 follow the operational member 221 to rotate. In particular, the resilient member 223 is supported by two shafts (2262 and 2263) of the bottom plate 226 such that the resilient member 223 is stationary relative to the central shaft 2261 when the rotary encoder 22 rotates. The shafts (2262 and 2263) of the bottom plate 226 extend through two rectangular holes (213 and 214), respectively. The shafts (2262 and 2263) also provide support to the rotary encoder 22 when the rotary encoder 22 moves toward the push switch 23.

Figure 1A:
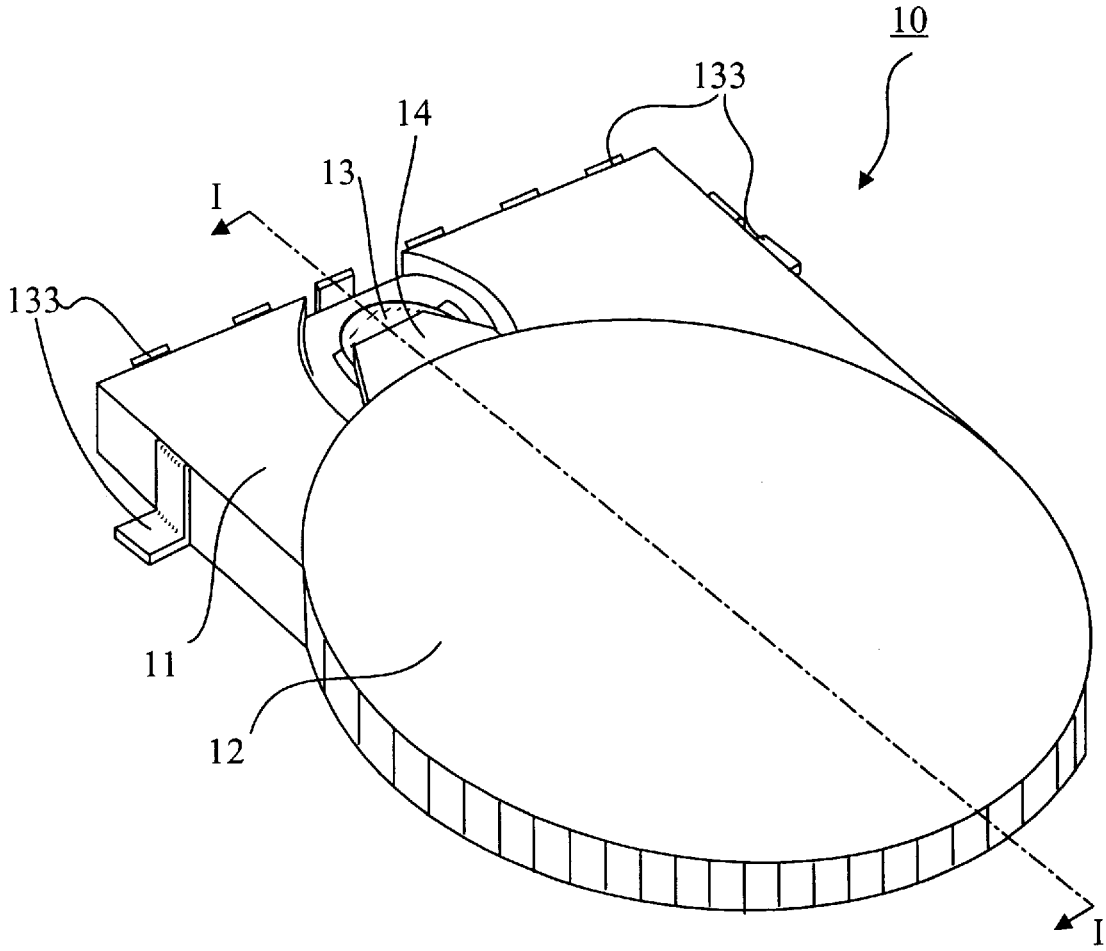
FIG. 1A(prior art)
FIG. 1B is an exploded perspective view of the electronic component 10 of FIG. 1A.
FIG. 1C is a cross section view of the electronic component 10 of FIG. 1A along A—A line.
Figure 1B:
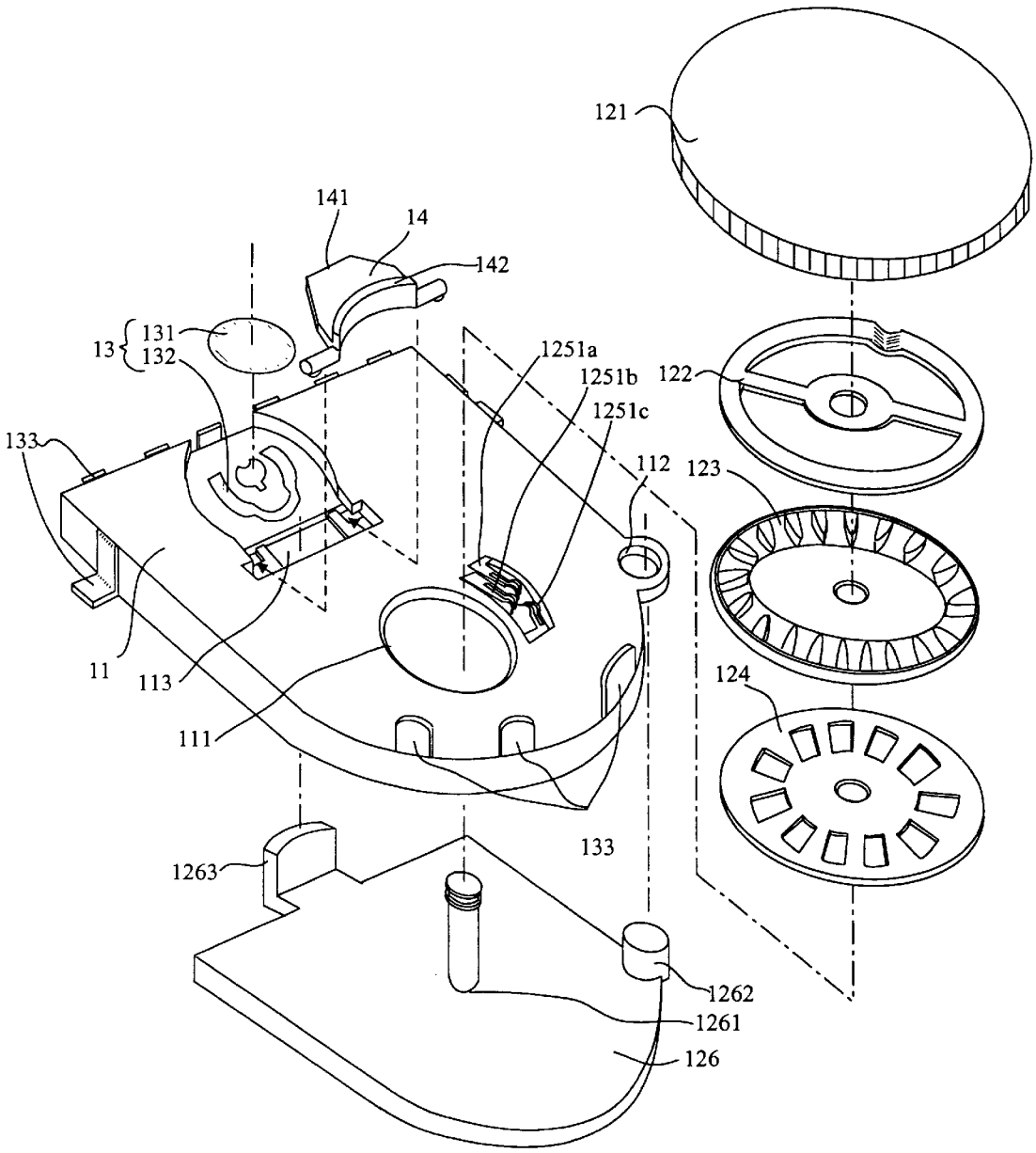
FIG. 1B(prior art)

In particular, the rotatable member 222 has a gear-shaped flange. The resilient member 223 has a V-shaped portion retained by a surface of the gear-shaped flange of the rotatable member 222 such that the rotary encoder 22 can be precisely adjusted. The resistance provided by the resilient member 223 is more than that provided by the lid plate 122 in FIG. 1B. Therefore, the rotary encoder 22 can be exact adjusted more under rotary operation.

Alternatively, the resilient member is formed into a resilient ring-like member as shown in FIG. 2D. The ring-like member 223 also has a V-shaped portion retained by a surface of the gear-shaped flange of the rotatable member 222 such that the rotary encoder 22 can be precisely adjusted. Otherwise, the ring-like member 223 is directly supported by retaining portions 216 disposed on the base plate 21 rather than the shafts (2262 and 2263) shown in FIG. 2B.

The resilient contact legs (2251*a*, 2251*b* and 2251*c*) extend upwards from a thin metal sheet inserted-molded within the base plate 21. The connecting terminals 233 extend upwards from a side end of the thin metal sheet 225 to provide connection of the rotary encoder 22 with an external circuit (not shown). The resilient contact legs (2251*a*, 2251*b* and 2251*c*) are disposed on a lower surface of the contact plate 224. The contact leg 2251*c* is always in touch with the contact plate 224. When the operational member 221 rotates, the contact legs (2251*a*, 2251*b* and 2251*c*) slide on the contact plate 224, and the contact legs 2251*a* and 2251*b* are in touch with the contact plate 224 alternately to generate switching signals. The contact leg 2251*c* is always in touch with the contact plate 224. The contact leg 2251*a* and the contact leg 225*b* are in touch with the contact plate 224 alternately. According to the contact sequence of the contact legs (2251*a* and 2251*b*) with the contact plate 224, the external circuit will receive the switching signals to adjust the volume of the corresponding option.

Figure 1C:
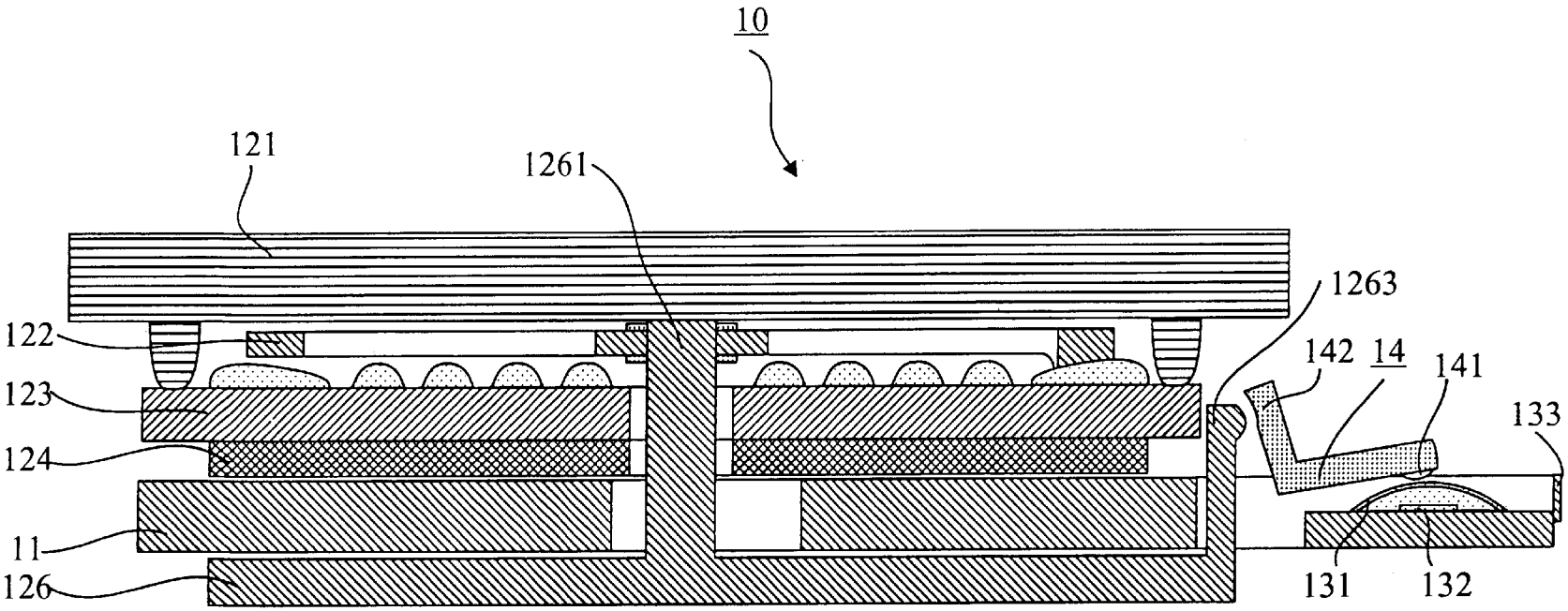
FIG. 1C(prior art)

Also shown in FIG. 2B, the push switch 22 includes a conductive dome-shaped member 231, a conductive patterned member 232 mounted on the rear wall 211, and connecting terminals 233 extending from the patterned member 232. The dome-shaped member 231 has a dome end and a circumference contacting the patterned member 232. When the dome end of the dome-shaped member 231 is pressed to contact the patterned member 232, the push switch 23 is switched on. It is noted that the push switch 23 gets a larger space than the push switch 13 in FIG. 1. Therefore, the dome-shaped member 231 can be made larger than the dome-shaped member 131 in FIGS. 1. In a preferred embodiment, the diameter of the dome-shaped member 231 is about 4.5 mm and the thickness of the dome-shaped member 232 is maintained at about 0.1 mm. In a practical fatigue test, the dome-shaped member 231, which is formed of a iron material and with the size mentioned above, has a fatigue life more than $3\times10^6$ cycles. It is evident that the life cycle of the push switch 23 of the invention is enhanced significantly.

The mechanism 24 is a bent arm member pivotally connected to the base plate 21 such that the mechanism 24 is allowed to rotate within a predetermined range. The mechanism 24 has an end 241 adjacent to the dome end of the dome-shaped member 2131 and a side 242 adjacent to the operational member 221. As shown in FIG. 2C, when the rotary encoder 22 moves toward the push switch 23, the mechanism 24 is actuated to press the dome end of the dome-shaped member 231 to contact the patterned member 232 for switching on the push switch 23.

In practical application, the complex electronic component 20 of the first embodiment can be fixed on a circuit board perpendicular to the base plate 21 via its rear wall 211 in a soldering or embedding manner. This can strengthen the support of the electronic component 20 on the circuit board to increase the reliability of the rotary encoder 20 under rotary and pushing operation.

Referring to FIGS. 3, a second embodiment of the invention is to provide a compact and complex electronic component 30 incorporating a rotary encoder 32 and two push switches (33 and 34). As shown in an outside perspective view in FIG. 3A, the complex electronic component 30, according to the second embodiment of the invention, mainly includes a base plate 31 having an upper rear wall 311 and a lower rear wall 312, the rotary encoder 32, the upper push switch 33 fixed on the upper rear wall 311, the lower push switch 34 fixed on the lower rear wall 312, a first mechanism 35 for selectively switching on the upper push switch 33, and a second mechanism 36 for selectively switching on the lower push switch 34. The rotary encoder 32 is attached movably and rotatably on the base plate 31 and spaced a predetermined distance apart from the push switches (33 and 34). Likewise, the rotary encoder 32 is capable of moving toward the push switches (33 and 34). Moreover, when the movement of the rotary encoder 32 toward the push switches (33 and 34) takes place, the first mechanism 35 and second mechanism 36, in the same time, are actuated to switch on the push switches 33 and 34, respectively.

The arrangement and cooperation between the members consisting of the electronic component 30 can be understood by FIG. 3B and FIG. 3C. FIG. 2B is an exploded perspective view of the electronic component 30. FIG. 3C is a sectional view of the electronic component 30 along A—A line in FIG. 3A.

Hereafter, the rotary encoder 32 and the push switches 33 and 34 will be described in detail, respectively. The essentials consisting of the rotary encoder 32 are the same as those consisting of the rotary encoder 22 in FIG. 2. The rotary encoder 32 includes an operational member 321, a rotatable member 322, a resilient member 323, a contact plate 324, resilient contact legs (3251*a*, 3251*b* and 3251*c*), connecting terminals 333, and a bottom plate 326. The bottom plate 326 has a central shaft 3261 extending through the center of the rotary encoder 32, which rotates around the central shaft 3261. The central shaft 3261 also extends through an elliptical hole 314. In particular, except for the bottom plate 326, all members of the rotary encoder 32 are attached movably above the base plate 31. The operational member 321 is operated by one operator's finger to rotate relative to the central shaft 3261 and move toward the push switch 33. When the operational member 321 rotates, the rotatable member 322 and the contact plate 324 follow the operational member 321 to rotate. The resilient member 323 is supported by two shafts (3262 and 3263) of the bottom plate 326 such that the resilient member 323 is stationary relative to the central shaft 3261 when the rotary encoder 32 rotates. The shafts (3262 and 3263) of the bottom plate 326 extend through two rectangular holes (314 and 315), respectively. The shafts (3262 and 3263) also provide support to the rotary encoder 32 when the rotary encoder 32 moves toward the push switches 33 and 34.

Likewise, the rotatable member 322 has a gear-shaped flange. The resilient member 323 has a V-shaped portion retained by a surface of the gear-shaped flange of the rotatable member 322 such that the rotary encoder 32 can be precisely adjusted.

The resilient contact legs (3251*a*, 3251*b* and 3251*c*) extend upwards from a thin metal sheet inserted-molded within the base plate 31. The connecting terminals 333 extend upwards from a side end of the thin metal sheet to provide connection of the rotary encoder 32 with an external circuit (not shown). The resilient contact legs (3251*a*, 3251*b* and 3251*c*) are disposed on a lower surface of the contact plate 324. The contact leg 3251*c* is always in touch with the contact plate 324. When the operational member 321 rotates, the contact legs (3251*a*, 3251*b* and 3251*c*) slide on the contact plate 324, and the contact legs 3251*a* and 3251*b* are in touch with the contact plate 324 alternately to generate switching signals. According to the contact sequence of the contact legs (3251*a* and 3251*b*) with the contact plate 324, the external circuit will receive the switching signals to adjust the volume of the corresponding option.

Also shown in FIG. 3B, the upper push switch 33 includes a conductive dome-shaped member 331 and a conductive patterned member 332 mounted on the upper rear wall 311. The lower push switch 34 includes a conductive dome-shaped member 341 and a patterned member 342 mounted on the lower rear wall 312. In the electronic component 30, the push switches (33 and 34) are connected to the external circuit through the connecting terminals 333. In each of the push switches (34 and 35), the dome-shaped member has a dome end and a circumference contacting the patterned member. When the dome end of the dome-shaped member is pressed to contact the patterned member, the corresponding push switch is switched on. It is noted that the dome-shaped members 331 and 341 can be made larger and have long fatigue life. That is the push switches 33 and 34 have high life cycles.

The first mechanism 35 and second mechanism 36 are a bent arm member, respectively. The first mechanism 35 has a shaft 351 extending through a hole 317 of the base plate 31 and received by a hole 361 of the second mechanism 36 such that the two mechanisms (35 and 36) can be actuated in the same time. The first mechanism 35 has an end 352 adjacent to the dome end of the dome-shaped member 331, and the second mechanism 36 has an end 362 adjacent to the dome end of the dome-shaped member 341. The first mechanism 35 also has a side 353 adjacent to the operational member 321. As shown in FIG. 2C, when the rotary encoder 32 moves toward the push switches 33 and 34, the first mechanism 35 is directly and the second mechanism 36, in the same time, is indirectly actuated to press the dome ends of the dome-shaped members 331 and 341 to contact the patterned member 332 and 342, respectively. Certainly, in mechanism design, if the first mechanism 35 is not directly actuated by the operational member 321, the electronic component 30 can be employed in another structure in which the second mechanism 36 is directly actuated by the bottom plate 326. Otherwise, if only fixed strength of the electronic component 30 on the circuit board is considered, the electronic component 30 can employed in another structure in which only one push switch is fixed on the upper rear wall 311 or lower rear wall 312.

Referring to FIG. 4, a third embodiment of the invention is to provide a compact and complex electronic component 40 incorporating a rotary encoder 42 and two push switches (43 and 44). As shown in an outside perspective view in FIG. 4A, the complex electronic component 40 mainly includes a base plate 41 having an upper rear wall 411 and a lower rear wall 412, the rotary encoder 42, the upper push switch 43, the lower push switch 44, a mechanism 45 for selectively switching on the upper push switch 43, and an actuator portion 4264 for switching on the lower push switch 44. The upper push switch 43 is fixed on the upper rear wall 411. The lower push switch 44 is fixed on the lower rear wall 412. The actuator portion 4264 is a portion of a bottom plate 426 of the rotary encoder 42 and integral with the bottom plate 4264. The rotary encoder 42 is attached movably and rotatably on the base plate 41 and spaced a predetermined distance apart from the push switches (43 and 44). Likewise, the rotary encoder 42 is capable of moving toward the push switches (43 and 44). Moreover, when the movement of the rotary encoder 42 toward the push switches (43 and 44) takes place, the mechanism 45 and the actuator portion 4264 of the bottom plate 426, in the same time, are actuated to switch on the push switches 43 and 44, respectively.

The arrangement and cooperation between the members consisting of the electronic component 40 can be understood by FIG. 4B and FIG. 4C. FIG. 4B is an exploded perspective view of the electronic component 40. FIG. 4C is a sectional view of the electronic component 40 along A—A line in FIG. 4A.

Hereafter, the rotary encoder 42 and the push switches 43 and 44 will be described in detail, respectively. The rotary encoder 42 includes an operational member 421, a rotatable member 422, a resilient member 423, a contact plate 424, resilient contact legs (4251*a*, 4251*b* and 4251*c*), connecting terminals 433, and the bottom plate 426. The bottom plate 426 has a central shaft 4261 extending through the center of the rotary encoder 42, which rotated around the central shaft 4261. The central shaft 4261 also extends through an elliptical hole 412 of the base plate 41 and the mechanism 45 which is fitted on the central shaft 4261 and located between the operational member 421 and the rotatable member 422. In particular, except for the bottom plate 426, all members of the rotary encoder 42 are attached movably above the base plate 41. The operational member 421 is operated by one operator's finger to rotate relative to the central shaft 4261 and move toward the push switches 43 and 44. When the operational member 421 rotates, the rotatable member 422 and the contact plate 424 follow the operational member 421 to rotate. The resilient member 423 is supported by two shafts (4262 and 4263) of the bottom plate 426 such that the resilient member 423 is stationary relative to the central shaft 4261 when the rotary encoder 42 rotates. The shafts (4262 and 4263) of the bottom plate 426 extend through two circular holes (414 and 415), respectively. The shafts (4262 and 4263) also provide support to the rotary encoder 42 when the rotary encoder 42 moves toward the push switches 43 and 44.

Likewise, the rotatable member 422 has a gear-shaped flange. The resilient member 423 has a V-shaped portion retained by a surface of the gear-shaped flange of the rotatable member 422 such that the rotary encoder 42 can be precisely adjusted.

The resilient contact legs (4251*a*, 4251*b* and 4251*c*) extend upwards from a thin metal sheet inserted-molded within the base plate 41. The connecting terminals 433 extend upwards from a side end of the thin metal sheet to provide connection of the rotary encoder 42 with an external circuit (not shown). The resilient contact legs (4251*a*, 4251*b* and 4251*c*) are disposed on a lower surface of the contact plate 424. The contact leg 4251*c* is always in touch with the contact plate 424. When the operational member 421 rotates, the contact legs (4251*a*, 4251*b* and 4251*c*) slide on the contact plate 424, and the contact legs 4251*a* and 4251*b* are in touch with the contact plate 424 alternately to generate switching signals. According to the contact sequence of the contact legs (4251*a* and 4251*b*) with the contact plate 424, the external circuit will receive the switching signals to adjust the volume of the corresponding option.

Also shown in FIG. 4B, the upper push switch 43 includes a conductive dome-shaped member 431 and a conductive patterned member 432 mounted on the upper rear wall 411. The lower push switch 44 includes a conductive dome-shaped member 441 and a patterned member 442 mounted on the lower rear wall 412. In the rotary encoder 40, the push switches (43 and 44) are connected to the external circuit through the connecting terminals 433.

In each of the push switches (43 and 44), the dome-shaped member has a dome end and a circumference contacting the patterned member. When the dome end of the dome-shaped member is pressed to contact the patterned member, the corresponding push switch is switched on. It is noted that the dome-shaped members 431 and 441 can be made larger and have long fatigue life, i.e., the push switches 43 and 44 have high life cycle. Otherwise, if only fixed strength of the electronic component 40 on the circuit board is considered, the electronic component 40 can employed in another structure in which only one push switch is fixed on the lower rear wall 412. This would not need the push switch 43 fixed on the upper rear wall 411 and the corresponding mechanism 45.

The first mechanism 45 is a plate-like member. The mechanism 45 has an end 451 adjacent to the dome end of the dome-shaped member 431, and the actuator portion 4264 is adjacent to the dome end of the dome-shaped member 441. As shown in FIG. 4C, when the rotary encoder 42 moves toward the push switch 43, the mechanism 45 and the actuator portion 4264 of the bottom plate 426, in the same time, are actuated to press the dome ends of the dome-shaped members 431 and 441 to contact the patterned member 432 and 442, respectively.

In practical application, the electronic component 30 provided by the second embodiment and the electronic component 40 provided by the third embodiment can be fixed on a circuit board perpendicular to their base plates via their upper and lower rear walls in a soldering or embedding manner. This can strengthen the support of the electronic components 30 and 40 on the circuit board to increase the reliability of their rotary encoders under rotary and pushing operation.

Referring to FIG. 5, a fourth embodiment of the invention is described in detail. As shown in an outside perspective view in FIG. 5A, the complex electronic component 50 mainly includes a base plate 51 defining an upper surface and a lower surface, a rotary encoder 52, a push switch 53, and a mechanism 54 for selectively switching on the push switch 53. In particular, the push switch 53 is disposed on the lower surface of the base plate 51. The rotary encoder 52 is attached movably and rotatably on the base plate 51 and spaced a predetermined distance apart from the push switch 53. The rotary encoder 52 is capable of moving backward. When the rotary encoder 52 moves backward, the mechanism 54 is actuated to switch on the push switch 53.

The arrangement and cooperation between the members consisting of the electronic component 50 can be understood by FIG. 5B and FIG. 5C. FIG. 5B is an exploded perspective view of the electronic component 50. FIG. 5C is a sectional view of the electronic component 50 along A—A line in FIG. 5A.

Hereafter, the rotary encoder 52 and the push switch 53 will be described in detail, respectively. The rotary encoder 52 includes an operational member 521, a rotatable member 522, a resilient member 523, a contact plate 524, resilient contact legs (5251*a*, 5251*b* and 5251*c*), connecting terminals 533, and a bottom plate 526. The bottom plate 526 has a central shaft 5261 extending through the center of the rotary encoder 52, which rotates around the central shaft 5261. The central shaft 5261 also extends through an elliptical hole 512. Except for the bottom plate 526, all member of the rotary encoder 52 are attached movably above the upper surface of the base plate 51. The operational member 521 is operated by one operator's finger to rotate relative to the central shaft 5261 or to move backward. When the operational member 521 rotates, the rotatable member 522 and the contact plate 524 follow the operational member 521 to rotate. In particular, the resilient member 523 is supported by two shafts (5262 and 5263) of the bottom plate 526 such that the resilient member 523 is stationary relative to the central shaft 5261 when the rotary encoder 52 rotates. The shafts (5262 and 5263) of the bottom plate 526 extend through a hole 512 and an opening 513, respectively. The shafts (5262 and 5263) also provide support to the rotary encoder 52 when the rotary encoder 52 moves backward.

In particular, the rotatable member 522 has a gear-shaped flange. The resilient 30 member 523 has a V-shaped portion retained by a surface of the gear-shaped flange of the rotatable member 522 such that the rotary encoder 52 can be precisely adjusted.

The resilient contact legs (5251*a*, 5251*b* and 5251*c*) extend upwards from a thin metal sheet inserted-molded within the base plate 51. The connecting terminals 533 extend upwards from a side end of the thin metal sheet to provide connection of the rotary encoder 52 with an external circuit (not shown). The resilient contact legs (5251*a*, 5251*b* and 5251*c*) are disposed on a lower surface of the contact plate 524. The contact leg 5251*c* is always in touch with the contact plate 524. When the operational member 521 rotates, the contact legs (5251*a*, 5251*b* and 5251*c*) slide on the contact plate 524, and the contact legs 5251*a* and 5251*b* are in touch with the contact plate 524 alternately to generate switching signals. According to the contact sequence of the contact legs (5251*a* and 5251*b*) with the contact plate 524, the external circuit will receive the switching signals to adjust the volume of the corresponding option.

Also shown in FIG. 5B, the push switch 52 includes a conductive dome-shaped member 531, a conductive patterned member 532 mounted on the lower surface of the base plate 51, and connecting terminals 533 extending from the patterned member 532. The dome-shaped member 531 has a dome end and a circumference contacting the patterned member 532. When the dome end of the dome-shaped member 531 is pressed to contact the patterned member 532, the push switch 53 is switched on. It is noted that the push switch 53 gets a larger space than the push switch 13 in FIG. 1. Therefore, the dome-shaped member 531 can be made larger than the dome-shaped member 131 in FIGS. 1. It is evident that the life cycle of the push switch 53 according to the invention is enhanced significantly.

The mechanism 54 is pivotally connected to the base plate 51 via two pivots 543 such that the mechanism 54 is allowed to rotate within a predetermined range of angle. The mechanism 54 has two actuated portions 541 projecting through two holes 514, respectively. Two actuating portions 5264 of the bottom plate 526 also respectively project through the two holes 514 and close to the actuated portions 541. The mechanism 54 has an end 542 adjacent to the dome end of the dome-shaped member 531. When the rotary encoder 52 moves backward, the actuated portions 541 of the mechanism 54 are actuated by the actuating portions 5264 of the bottom plate 526. In the same time, the end 542 of the mechanism 54 is actuated to press the dome end of the dome-shaped member 531 to contact the patterned member 532 for switching on the push switch 53.

Certainly, in the fourth embodiment, if the fixed strength of the electronic component 50 is considered, the upper rear wall and/or the lower rear wall can be provided and fixed on a circuit board perpendicular to the base plate 51 in a soldering or embedding manner. This can strengthen the support of the electronic component 50 on the circuit board to increase the reliability of the rotary encoder 52 under rotary and pushing operation.

Referring to FIGS. 6, a fifth embodiment of the invention is described in detail. As shown in an outside perspective view in FIG, 6A, the complex electronic component 60 mainly includes a base plate 61 defining an upper surface and a lower surface, a rotary encoder 62, a push switch 63, and a mechanism 64 for selectively switching on the push switch 63. In particular, the push switch 63 is disposed on the lower surface of the base plate 61. The rotary encoder 62 is attached movably and rotatably on the base plate 61 and spaced a predetermined distance apart from the push switch 63. Likewise, the rotary encoder 62 is capable of moving backward. When the rotary encoder 62 moves backward, the mechanism 64 is actuated to switch on the push switch 63.

The arrangement and cooperation between the members consisting of the electronic component 60 can be understood by FIG. 6B and FIG. 6C. FIG. 6B is an exploded perspective view of the electronic component 60. FIG. 6C is a sectional view of the electronic component 60 along A—A line in FIG. 6A.

Hereafter, the rotary encoder 62 and the push switch 63 will be described in detail, respectively. The rotary encoder 62 includes an operational member 621, a rotatable member 622, a resilient member 623, a contact plate 624, resilient contact legs (6251*a*, 6251*b* and 6251*c*), connecting terminals 633, and a bottom plate 626. The bottom plate 626 has a central shaft 6261 extending through the center of the rotary encoder 62, which rotates around the central shaft 6261. The central shaft 6261 also extends through an elliptical hole 612. Except for the bottom plate 626, all member of the rotary encoder 62 are attached movably above the upper surface of the base plate 61. The operational member 621 is operated by one operator's finger to rotate relative to the central shaft 6261 or to move backward. When the operational member 621 rotates, the rotatable member 622 and the contact plate 624 follow the operational member 621 to rotate. In particular, the resilient member 623 is supported by two shafts (6262 and 6263) of the bottom plate 626 such that the resilient member 623 is stationary relative to the central shaft 6261 when the rotary encoder 62 rotates. The shafts (6262 and 6263) of the bottom plate 626 extend through two circular holes (612 and 613), respectively. The shafts (6262 and 6263) also provide support to the rotary encoder 62 when the rotary encoder 62 moves backward.

In particular, the rotatable member 622 has a gear-shaped flange. The resilient 5 member 623 has a V-shaped portion retained by a surface of the gear-shaped flange of the rotatable member 622 such that the rotary encoder 62 can be precisely adjusted.

The resilient contact legs (6251*a*, 6251*b* and 6251*c*) extend upwards from a thin metal sheet inserted-molded within the base plate 61. The connecting terminals 633 extend upwards from a side end of the thin metal sheet to provide connection of the rotary encoder 62 with an external circuit (not shown). The resilient contact legs (6251*a*, 6251*b* and 6251*c*) are disposed on a lower surface of the contact plate 624. The contact leg 6251*c* is always in touch with the contact plate 624. When the operational member 621 rotates, the contact legs (6251*a*, 6251*b* and 6251*c*) slide on the contact plate 624, and the contact legs 6251*a* and 6251*b* are in touch with the contact plate 624 alternately to generate switching signals. According to the contact sequence of the contact legs (6251*a* and 6251*b*) with the contact plate 624, the external circuit will receive the switching signals to adjust the volume of the corresponding option.

Also shown in FIG. 6B, the push switch 62 includes a conductive dome-shaped member 631, a conductive patterned member 632 mounted on the lower surface of the base plate 61, and connecting terminals 633 extending from the patterned member 632. The dome-shaped member 631 has a dome end and a circumference contacting the patterned member 632. When the dome end of the dome-shaped member 631 is pressed to contact the patterned member 632, the push switch 63 is switched on. It is noted that the dome-shaped member 631 can be made larger. It is evident that the life cycle of the push switch 63 according to the invention is enhanced significantly.

The mechanism 64 is pivotally connected to the base plate 61 such that the mechanism 64 is allowed to rotate within a predetermined range. The mechanism 64 has an end 641 adjacent to the dome end of the dome-shaped member 631 and a side 642 adjacent to the operational member 621. When the rotary encoder 62 moves backward, the mechanism 64 is actuated to press the dome end of the dome-shaped member 631 to contact the patterned member 632 for switching on the push switch Certainly, in the fifth embodiment, if the fixed strength of the electronic component 60 is considered, the upper rear wall and/or the lower rear wall can be provided and fixed on a circuit board perpendicular to the base plate 61 in a soldering or embedding manner. This can strengthen the support of the electronic component 60 on the circuit board to increase the reliability of the rotary encoder 62 under rotary and pushing operation.

The above details of the preferred embodiments of the aforesaid invention are illustrative rather than limiting. For instance, the mechanism for selectively switching on the push switch and the member for resisting the rotary operation of the rotary encoder according to the invention may be replaced equivalently by other forms which are obvious to persons skillful in the arts. Accordingly, any equivalent modifications, substitutes, alterations or changes to the preferred embodiment without departing form the spirit of the invention are likely to persons with ordinary skills in the arts, and are still within the intended scope of the protection of the invention.

What is claimed is:

1. An electronic component comprising:

a base plate having a rear wall;

a rotary encoder attached movably and rotatably on said base plate, said rotary encoder generating a switching signal when rotating;

at least one push switch disposed on the rear wall;

wherein said rotary encoder comprises:

an operational member, the operational member being rotatably attached to said base plate;

a rotatable member having a gear-shaped flange, the rotatable member following the operational member to rotate;

a resilient member, the resilient member being stationary relative to the center of the operational member, the resilient member having a V-shaped portion retained by a surface of the gear-shaped flange such that said rotary encoder is precisely adjusted when said rotary encoder rotates;

a first contact attached to a lower surface of the rotatable member; and a second contact being resilient and in touch with the first contact, the second contact sliding on said first contact to generate the switching signal when said rotary encoder rotates;

wherein said rear wall includes an upper rear wall and a lower rear wall, and said at least one push switch includes a first push switch and a second push switch, wherein said first push switch is disposed on said upper rear wall, and wherein said second push switch is disposed on said lower rear wall;

a first switching mechanism for selectively switching on said first push switch in response to the movement of said rotary encoder; and a second switching mechanism for selectively switching on said second push switch in response to the movement of said rotary encoder.

2. The electronic component of claim 1, wherein said first push and said second push switches comprise a conductive patterned member and a conductive dome-shaped member, respectively, said patterned member is mounted on one corresponding rear wall, said dome-shaped member has a dome end and a circumference contacting one corresponding patterned member, when said dome end of said dome-shaped member is pressed to contact said patterned member, one corresponding push switch is switched on.

3. The electronic component of claim 2, wherein the first switching mechanism and the second switching mechanism is a bent arm member, respectively, the bent arm member has a first end pivotally connected to the base plate and a second end adjacent to the dome end of one corresponding dome-shaped member, and when the movement of said rotary encoder takes place, the second end of the bent arm member is actuated to press the dome end of the dome-shaped member to contact one corresponding patterned member.

4. The electronic component of claim 2, wherein said first switching mechanism and said second switching mechanism is a plate-like member, respectively, the plate-like members is engaged with said rotary encoder and has an end adjacent to the dome end of one corresponding dome-shaped member, and when the movement of said rotary encoder takes place, the end of the plate-like member is actuated to press the dome end of the dome-shaped member to contact one corresponding patterned member.

5. A electronic component comprising:

a base plate defining a lower surface;

a rotary encoder attached movably and rotatably on said base plate, said rotary encoder generating a switching signal when rotating;

a push switch disposed on the lower surface of said base plate;

a switching mechanism for selectively switching on said push switch in response to the movement of said rotary encoder.

6. The electronic component of claim 5, wherein said rotary encoder comprises:

a central shaft extending through a center of said rotary encoder;

an operational member, the operational member being rotatable circumferentially relative to the central shaft;

a rotatable member having a gear-shaped flange, the rotatable member following the operational member to rotate;

a resilient member, the resilient member being stationary relative to the central shaft, the resilient member having a V-shaped portion retained by a surface of the gear-shaped flange such that said rotary encoder is exact adjusted when rotating;

a first contact attached to a lower surface of the rotatable member; and a second contact being resilient, the second contact being in touch with the first contact, the second contact sliding on the first contact to generate the switching signal when said rotary encoder rotates.

7. The electronic component of claim 6, wherein said push switch comprises a conductive patterned member and a conductive dome-shaped member, the patterned member is mounted on the lower surface of said base plate, the dome-shaped member has a dome end and a circumference contacting the patterned component, when the dome end of the dome-shaped component is pressed to contact the patterned component, said push switch is switched on.

8. The electronic component of claims 7, wherein said switching mechanism is pivotally connected to said base plate, said switching mechanism has an end adjacent to the dome end of the dome-shaped member of the push switch, and when the movement of said rotary encoder takes place, the end of said switching mechanism is actuated to press the dome end of the dome-shaped member to contact the patterned member.

* * * * *